US006073300A

United States Patent [19]

Zahuranec et al.

[11] Patent Number: 6,073,300

[45] Date of Patent: Jun. 13, 2000

[54] VALVE ASSEMBLY FOR CARPET EXTRACTOR

[75] Inventors: Terry L. Zahuranec, North Olmsted; David J. Boll, Lakewood, both of Ohio

[73] Assignee: Royal Appliance Mfg. Co., Cleveland, Ohio

[21] Appl. No.: 09/227,671

[22] Filed: Jan. 8, 1999

[51] Int. Cl.[7] ..... A47L 11/30

[52] U.S. Cl. ..... 15/320; 15/321; 15/328; 15/334

[58] Field of Search ..... 15/320, 321, 334, 15/328; 239/302, 375, 443, 444, 446, 569; 137/878, 881; 251/149.6

[56] References Cited

U.S. PATENT DOCUMENTS

| | | | |
|---|---|---|---|
| 692,480 | 2/1902 | Robertshaw | 126/350 R |
| 1,023,630 | 4/1912 | Elkins | 134/44 |
| 2,333,829 | 11/1943 | Terry | 15/320 |
| 2,716,998 | 9/1955 | Knasko | 137/231 |
| 3,688,339 | 9/1972 | Vincent et al. | 15/387 |
| 3,797,065 | 3/1974 | Hughes | 15/353 |
| 3,939,527 | 2/1976 | Jones | 15/353 |
| 4,167,799 | 9/1979 | Webb | 15/320 |
| 4,570,856 | 2/1986 | Groth et al. | 239/310 |
| 4,724,573 | 2/1988 | Ostergaard | 15/321 |
| 4,809,397 | 3/1989 | Jacobs et al. | 15/320 |
| 4,893,375 | 1/1990 | Girman et al. | 15/320 |
| 4,967,794 | 11/1990 | Tsutsui et al. | 137/597 |
| 5,052,725 | 10/1991 | Meyer et al. | 285/308 |
| 5,180,439 | 1/1993 | Allison | 134/21 |
| 5,335,696 | 8/1994 | McKenzie | 137/883 |
| 5,493,752 | 2/1996 | Crouser et al. | 15/321 |
| 5,500,977 | 3/1996 | McAllise et al. | 15/320 |
| 5,549,134 | 8/1996 | Browne et al. | 137/606 |
| 5,615,448 | 4/1997 | Crouser et al. | 15/321 |
| 5,711,508 | 1/1998 | Schreiber et al. | 251/149.6 |
| 5,715,566 | 2/1998 | Weaver et al. | 15/320 |
| 5,761,763 | 6/1998 | McAllise et al. | 15/320 |
| 5,874,755 | 7/1998 | Karr et al. | 15/320 |
| 5,937,475 | 8/1999 | Kasen et al. | 15/320 |
| 5,983,442 | 11/1999 | Louis et al. | 15/320 |

OTHER PUBLICATIONS

Chemstractor® V™ by Chemspec, Brochure "*5 professional cleaning systems in 1 high–tech machine*".

Chemstractor® V™, "Operating Instructions and Parts List—Patent Nos. 3686707, 3797065, 4642842 Canadian Patent 1974", Chemical Specialites Manufacturing Corp., Baltimore, Maryland, 1M–3–93.

*Primary Examiner*—Theresa T. Snider

*Attorney, Agent, or Firm*—Fay, Sharpe, Fagan, Minnich & McKee, LLP

[57] ABSTRACT

A carpet extractor valve assembly (340,522) alternately directs cleaning solution to a base-mounted spray bar (74, 526) or to a remote distributor (438,614) of an accessory tool (16,524). The valve assembly includes an inlet port (344), which receives cleaning fluid from a handle-mounted reservoir (14,574), and first and second discharge ports (400, 442), connected to the spray bar and the accessory tool, respectively. First and second valve members (352,354) include first and second poppets (362, 444), which are biased by a spring (384) to normally-closed positions in which the first and second discharge ports are sealed. A trigger-operated actuation rod (410) actuates the first valve member to release cleaning fluid to the spray bar. A quick connect coupling (464,466,608,610) connects the remote distributor with the second discharge port and opens the second valve member thereby. In one embodiment, a cleaning solution pump (480), mounted in a pump housing (490) over a base assembly A, is coupled between the valve assembly (340) and the remote distributor (438). In another embodiment, a pump (520) is connected between a cleaning solution tank (574) and the valve assembly inlet port and pressurizes cleaning fluid for both the spray bar (526) and the remote distributor (614).

23 Claims, 23 Drawing Sheets

VALVE ASSEMBLY FOR CARPET EXTRACTOR

BACKGROUND OF THE INVENTION

The present invention relates to the carpet extractor arts. It finds particular application in conjunction with the cleaning of floors and above-floor surfaces, such as upholstery, stairs, and the like, using a liquid cleaning fluid.

Carpet extractors of the type which apply a cleaning solution to a floor surface and then recover dirty fluid from the surface are widely used for cleaning carpeted and wooden floors in both industrial and household settings. Generally, a vacuum source, such as a vacuum pump, is mounted within a base portion of the extractor and applies a vacuum to a nozzle adjacent the floor surface. A trigger, or other release mechanism is actuated to deliver cleaning solution from a reservoir to a floor distributor. For above floor cleaning, such as cleaning of upholstery and stairs, an attachment tool is often coupled to the extractor with a remote cleaning solution distributor and suction nozzle. It is desirable for these to be coupled easily to the reservoir and vacuum source in a manner which redirects the supply of cleaning solution and vacuum from the floor-mounted suction nozzle to the accessory. Conventional carpet extractors often require a complex series of connections to be made. Conventional carpet extractors employ several valves in this process, adding to the cost of the extractor and taking up space on the extractor.

Accordingly, it has been considered desirable to develop a new and improved carpet extractor which provides ease of coupling of a remote attachment for access to hard to reach areas and selective supply of cleaning solution to the attachment and the floor. The present invention provides a new and improved apparatus and method for which overcomes the above-referenced problems and others while providing better and more advantageous results.

SUMMARY OF THE INVENTION

In accordance with one aspect of the present invention a carpet extractor is provided. The extractor includes an extractor housing. A reservoir is mounted on the extractor housing for storing and providing a supply of cleaning solution. A distributor is mounted on the extractor housing and communicates with the reservoir for selectively applying the cleaning solution to a floor surface to be cleaned. A cleaning accessory tool includes a cleaning solution supply hose which selectively communicates with the reservoir for selectively applying the cleaning solution to a remote surface. A valve assembly is mounted on the extractor housing and is in fluid communication with the reservoir and the distributor and selectively in communication with the cleaning solution supply hose of the cleaning accessory tool for selectively delivering cleaning solution to at least one of the distributor and the accessory tool.

In accordance with a more limited aspect of this aspect of the present invention, the valve assembly includes a valve housing with a chamber. An inlet port, in fluid communication with the reservoir, and first and second spaced discharge ports, in fluid communication with the distributor and the cleaning solution supply hose, respectively, are defined on walls of the chamber. First and second discharge valves are located in the valve housing and selectively seal the first and second discharge ports to control the delivery of cleaning solution to the distributor and the accessory tool cleaning solution supply hose, respectively.

In accordance with a yet more limited aspect of this aspect of the present invention, the valve assembly further includes a compression spring which biases a first poppet to a sealing position in which the first poppet engages a first valve seat and which biases a second poppet to a sealing position in which the second poppet engages a second valve seat to close the first and second discharge valves, respectively. An actuator, such as a trigger-actuated actuation rod, selectively engages the first poppet for translating the poppet between the sealing position and an open position, in which a fluid flow path is defined between the inlet port and the first discharge port. The second poppet preferably includes a valve stem slidingly received in a valve stem passage and defining an interior bore, in fluid communication with the second discharge port, and an aperture. The valve stem selectively seals the second discharge port in a first position and provides fluid communication between the chamber and the discharge port in a second position.

In accordance with another, more limited aspect of this aspect of the present invention, a coupling assembly in fluid communication with the accessory tool cleaning solution supply hose selectively couples and uncouples the cleaning solution supply hose and the second discharge port. The coupling assembly is configured for opening the second discharge valve when the cleaning solution supply hose and the second discharge port are coupled.

In accordance with another limited aspect, a solution supply pump selectively supplies cleaning solution under pressure to the accessory tool. The solution supply pump may be fluidly connected between the accessory tool cleaning solution supply hose and the valve assembly or between the reservoir and the valve assembly. The pump may be enclosed in a pump housing which is configured for selectively mounting and dismounting over an inlet slot of a recovery tank mounted on the housing. The inlet may include a wall which closes a fluid flowpath between a suction nozzle inlet and the pump housing is mounted over the recovery tank.

In accordance with another limited aspect, the extractor includes a solution supply pump, fluidly connected between the reservoir and the valve assembly, for selectively supplying cleaning fluid under pressure to one of the accessory tool and the distributor.

In accordance with another aspect of the present invention, a carpet extractor is provided. The extractor includes an extractor housing, a cleaning fluid reservoir mounted on the extractor housing for holding a cleaning fluid, and a distribution bar mounted on the extractor housing for distributing the cleaning fluid to a floor surface to be cleaned. A first fluid line is located on the extractor housing and communicates the distribution bar with the reservoir. A valve assembly is mounted on the extractor housing and communicates with the first fluid line for controlling the delivery of cleaning fluid to the distribution bar. A cleaning accessory tool is selectively connected to the valve assembly for applying cleaning fluid to an above-floor surface. A second fluid line is connected to the cleaning accessory tool for communicating with the valve assembly. The valve assembly controls the delivery of cleaning fluid to the cleaning accessory tool. A pump for pressurizing the cleaning fluid being delivered to the cleaning accessory tool communicates with at least one of the first fluid line and the second fluid line. The pump is mounted on one of the extractor housing and the cleaning accessory tool.

In accordance with more limited aspects of this aspect of the present invention, the valve assembly comprises a valve housing with a chamber and an inlet port, a first discharge port, and a second discharge port each defined on a wall of the chamber and spaced from each other. First and second poppet valves are located in the chamber for selectively closing the first and second discharge ports. A biasing member, such as a spring, urges the first and second poppet valves into a closed position. An opening element, such an actuation rod, urges the first poppet valve from the closed position to an open position. A quick connect coupling is selectively coupled between the second fluid line and the valve assembly. The second poppet valve is translated between the closed position and an open position when the quick connect coupling is coupled.

In accordance with yet another aspect of the present invention, a floor cleaner is provided. The cleaner includes a base housing and a valve assembly for selectively delivering a fluid through at least a selected one of first and second discharge ports. The valve assembly includes a first discharge valve, which selectively seals the first discharge port in a first position and opens the first discharge port in a second position to deliver the fluid from the first discharge port, and a second discharge valve, which selectively seals the second discharge port in a first position and opens the second discharge port in a second position to deliver the fluid from the second discharge port. A first distributor is mounted on the housing for applying the fluid to a floor surface. The first distributor is in fluid communication with the first discharge port. An attachment tool is selectively connectable to the valve assembly. The attachment tool includes a second distributor for applying the cleaning fluid to a remote surface. The second distributor is in fluid communication with the second discharge port when the tool is connected to the valve assembly.

One advantage of the present invention is the provision of a carpet extractor valve assembly in fluid communication with a reservoir, a distributor and a cleaning accessory tool for selectively delivering cleaning solution to one of the distributor and the accessory tool.

Another advantage of the present invention is the provision of a biasing member, such as a spring, for biasing first and second discharge valves of the valve assembly to a closed position, whereby the flow of cleaning solution to the distributor and the accessory tool, respectively, is prevented.

Still another advantage of the present invention is the provision of an actuator, such as an actuation rod, for opening the first discharge valve.

Yet another advantage of the present invention is the provision of a coupling assembly, such as a quick connect coupling on an accessory tool cleaning solution supply hose, which opens the second discharge valve when the coupling assembly is coupled to the second discharge valve.

A further advantage of the present invention is the provision of a solution supply pump for selectively supplying cleaning solution under pressure to an accessory tool or to a distributor mounted on a base housing of the carpet extractor.

A still further advantage of the present invention is the provision of a pump housing for the pump, the housing having an inlet tube which has one end which selectively receives the cleaning accessory tool suction hose and another end configured for insertion into a recovery tank inlet slot. A wall of the housing closes a fluid flow path between the nozzle and the recovery tank when the housing is mounted on the recovery tank.

Still other benefits and advantages of the present invention will become apparent to those skilled in the art upon a reading and understanding of the following detailed specification.

BRIEF DESCRIPTION OF THE DRAWINGS

The invention takes form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
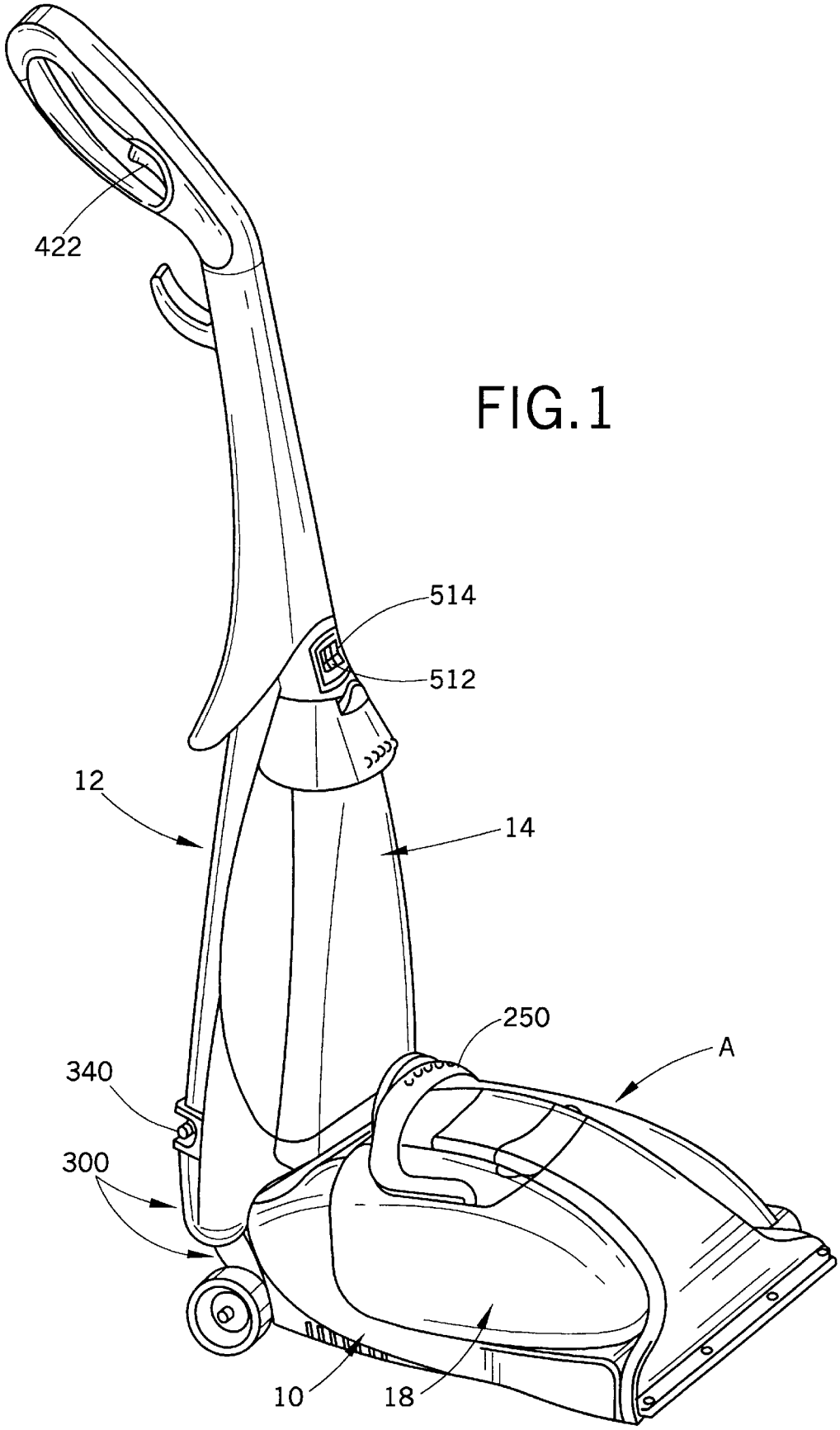
FIG. 1 is a perspective view of an upright carpet extractor according to the present invention.
Figure 2:
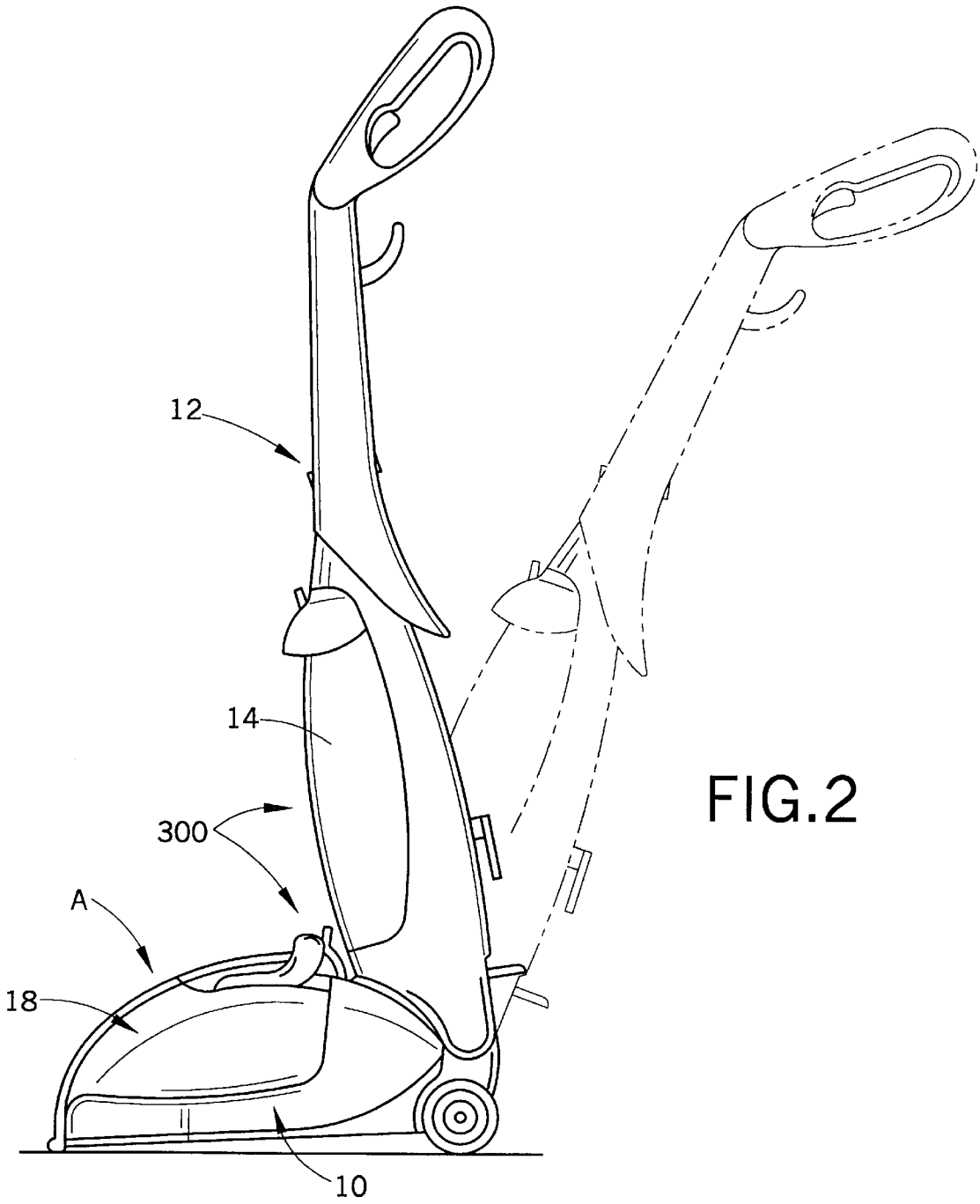
FIG. 2, is a side elevational view of the carpet extractor of FIG. 1, showing a directing handle assembly in an upright position and in a working position (in phantom)

Referring now to the drawings, wherein the showings are for purposes of illustrating preferred embodiments of the invention only and are not for purposes of limiting the same, FIGS. 1 and 2 show an upright carpet extractor. The extractor includes a base assembly A having a base housing 10. A directing handle assembly 12 is pivotally connected to the base housing 10 for manipulating the base assembly over a floor surface to be cleaned. A cleaning solution supply tank or reservoir 14 is removably supported on the handle assembly 12 for supplying cleaning solution to a floor surface or to an optional hand-held accessory tool 16 (FIG. 3) for remote cleaning. A recovery tank and nozzle assembly 18 is removably supported on the base housing 10. A vacuum source, such as a motor and fan assembly 20 (FIG. 4) is supported on the base housing 10 rearward of the recovery tank assembly for drawing a vacuum.

Figure 4:
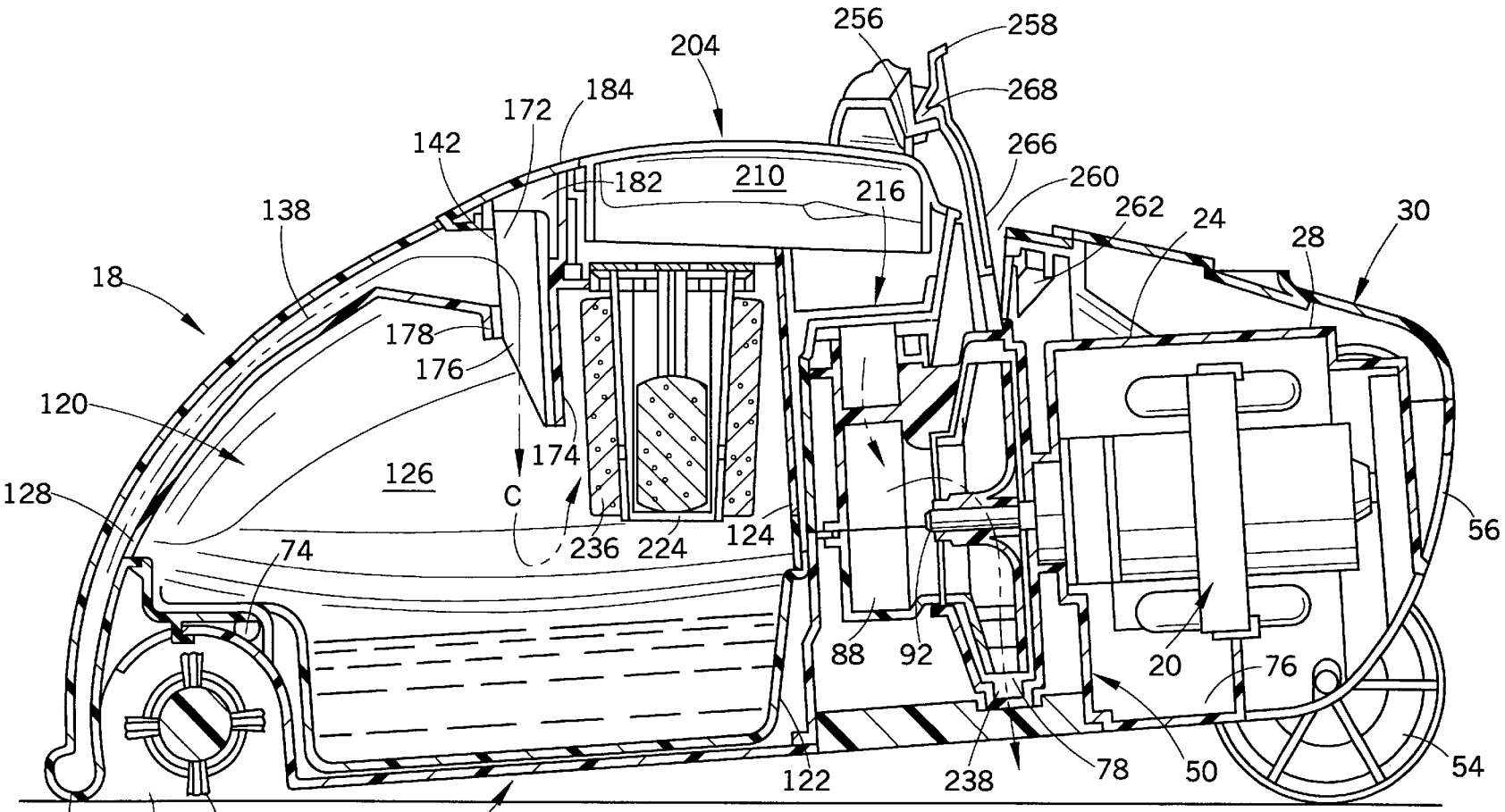
FIG. 4 is an enlarged side sectional view of the base assembly of the carpet extractor of FIG. 1.
Figure 5:
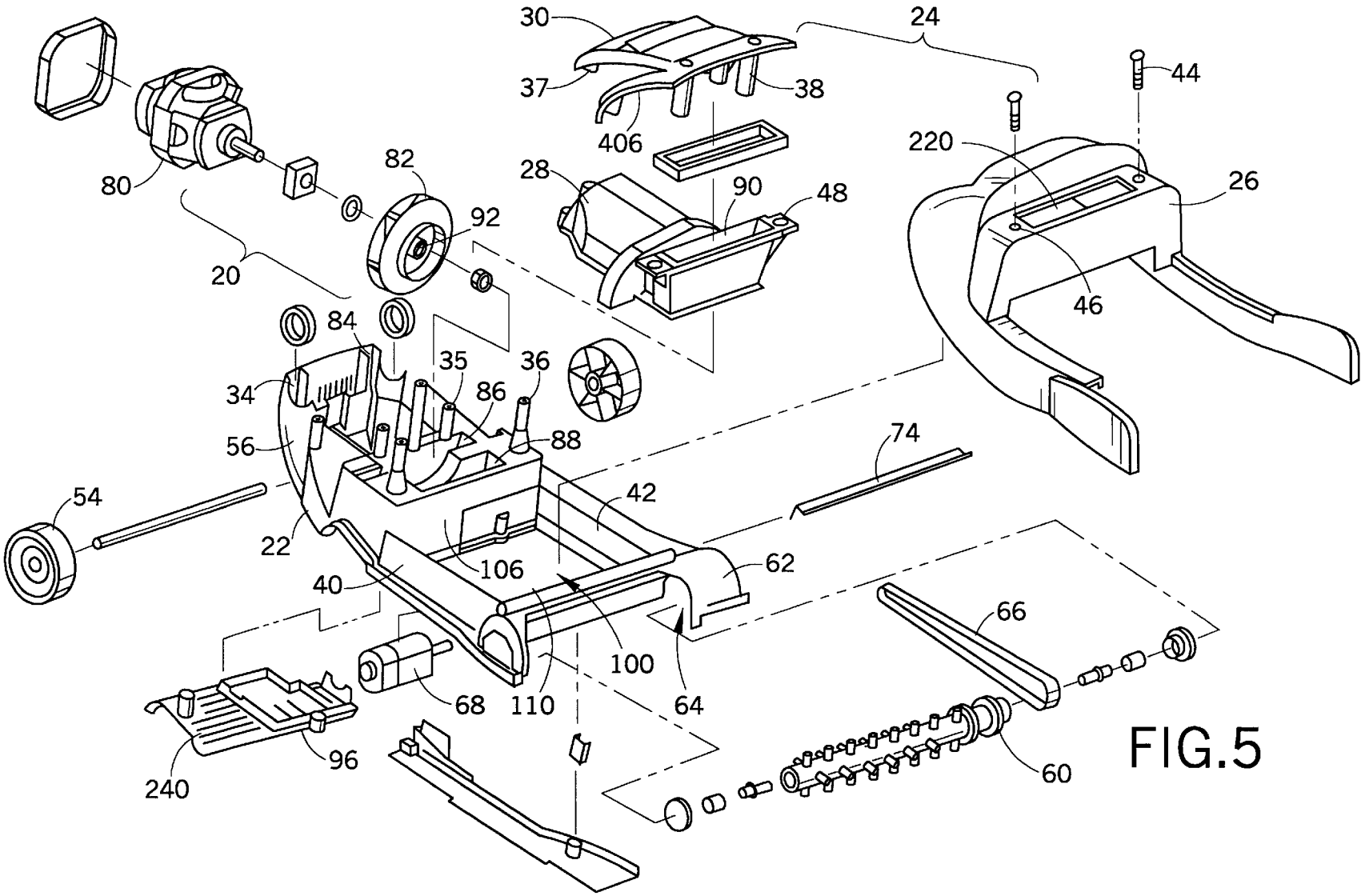
FIG. 5 is a reduced exploded perspective view of the base assembly of FIG. 4 without a recovery tank and nozzle assembly thereof.
Figure 6:
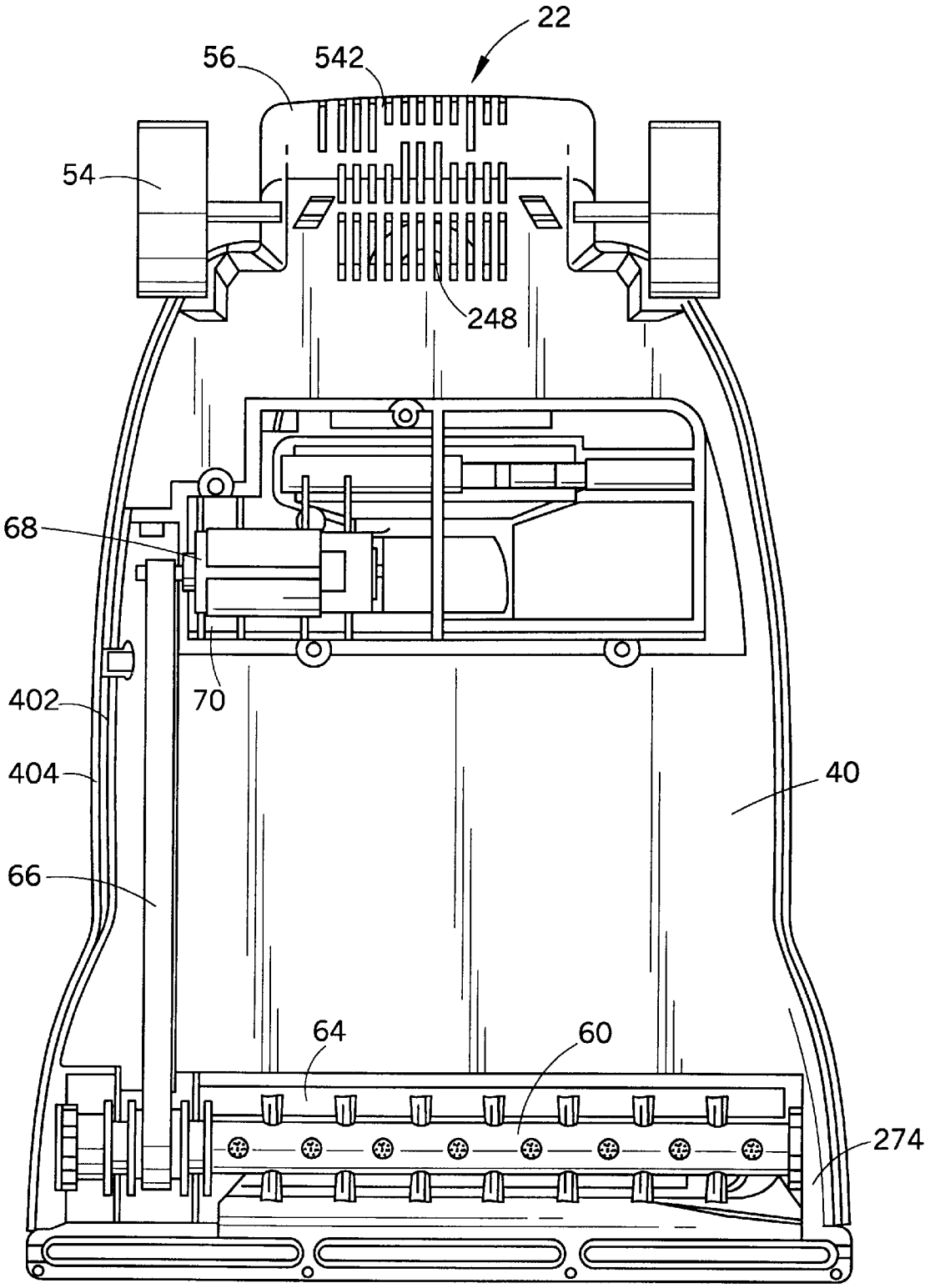
FIG. 6 is an enlarged bottom plan view of the base assembly of FIG. 4.
Figure 7:
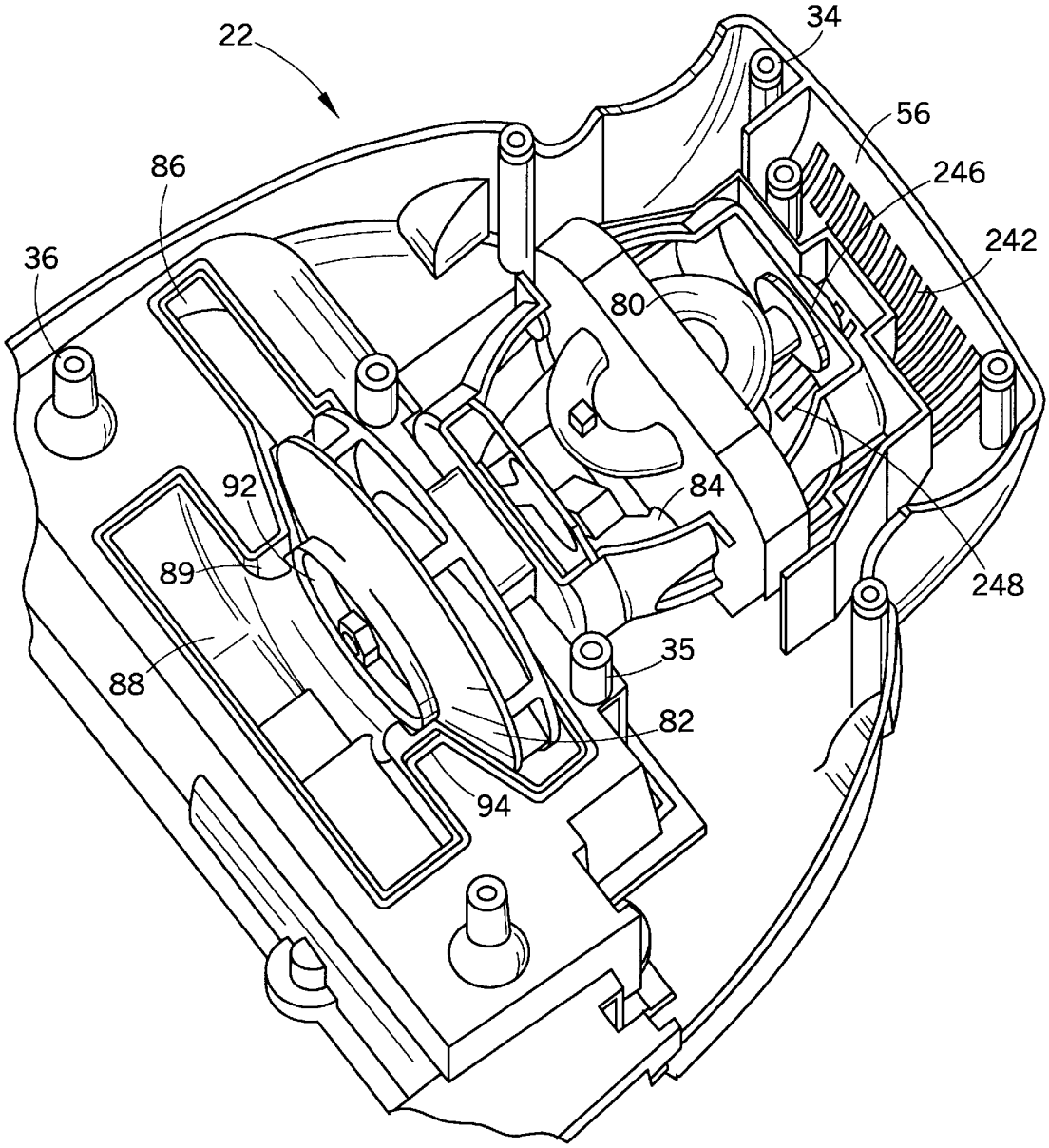
FIG. 7 is an enlarged perspective view of a rear portion of the base assembly of FIG. 4 with certain portions removed for clarity.

With reference to FIGS. 4–7, the base housing 10 includes a unitary molded lower housing portion 22 and an upper housing portion 24 including a front hood 26, a motor cover 28, and a rear cosmetic cover 30, which overlies a rearward portion of the motor cover. The motor cover and lower housing portion are joined together by bolts, screws, or other suitable fixing members to enclose the motor and fan assembly 20. Specifically, as shown in FIGS. 5 and 7, posts 34, 35, and 36, are formed in the lower housing portion and posts 37 and 38 are formed on the cosmetic cover 30. The posts 34, 35, and 37,38 are aligned and receive threaded screws for connecting the two parts together. The motor cover 28 is trapped between the lower housing portion 22 and the cosmetic cover 30. The front hood partially extends over the motor cover and the cosmetic cover and is positioned adjacent opposing vertical side walls 40 and 42 of the lower housing portion, which extend forwardly to provide part of a cosmetic housing shell for the base assembly. The front hood is attached to the lower housing portion and the motor cover by screws 44 or other suitable fixing means. As shown in FIG. 5, two screws are received in laterally spaced holes 46 in the front hood which are positioned over the posts 36 and corresponding threaded bores 48 on the motor cover. Together, the lower housing portion 22 and the motor cover 28 define a chamber 50 for receiving the suction motor and fan assembly 20. The chamber is preferably located along an axial center line of the base housing 10.

Laterally displaced wheels 54 are journaled into a rearward end 56 of the lower housing portion 22. A rotatable brushroll 60, for agitating the floor surface to be cleaned, is mounted adjacent a forward end 62 of the lower housing portion 22 in a downwardly facing integral cavity 64 defined by a lower surface of the lower housing portion. The brushroll is rotated by a motor-driven belt 66. A motor 68 for the belt is supported by the lower housing portion 22 in an integral indentation or pocket 70 defined beneath the motor and fan assembly 20, shown most clearly in FIG. 6. As shown in FIG. 4, a cleaning solution distributor, such as a drool or spray bar 74, mounted to the lower housing portion 22 above the brushroll 60, directs cleaning solution onto the floor surface via the brushroll.

The chamber 50 for the motor and fan assembly is divided into interconnected compartments or cavities, namely a rearward motor housing compartment 76 and a forward fan housing compartment 78 which receive a motor portion 80 and suction fan portion 82 of the motor and fan assembly 20, respectively. Integrally molded into an upper surface of a rearward portion of the lower housing portion 22 are lower portions 84 and 86 of motor and fan housing compartments 76 and 78, respectively. The motor cover 28 defines top portions of the housing compartments 76 and 78 for the motor and fan portions 80 and 82, respectively.

A vertically extending inlet chamber 88 is molded into a forward portion of the lower housing portion 22, forward of the fan compartment and communicating with the fan compartment via a central opening 89. A forward portion of the motor cover defines an upper portion 90 of the inlet chamber through which working air is drawn into the fan portion. Air entering the inlet chamber passes into an eye 92 the fan. The fan compartment is indented in an annular ring 94 adjacent the eye of the fan so that all air entering the inlet chamber passes through the eye of the fan. A louvered plate 96 (FIG. 5) is removably affixed below the lower housing portion 22 adjacent the motor and fan assembly 20 and brushroll motor 68.

The front hood 26 is seated over the lower housing portion 22 and a forward end of the motor cover 28 to provide part of a cosmetic cover for the components of the base assembly A. Together, the front hood and the lower housing portion define a socket or well 100 for receiving the recovery tank and nozzle assembly 18. The socket includes opposing side walls 40 and 42, defined by the lower housing portion 22, a rear wall 106 defined between the socket and the inlet chamber 90 to the fan housing compartment 78, a front wall 108, defined between the socket and the brushroll cavity 64, and a base 110, extending from lower ends of the four walls 40,42,106,108.

With continued reference to FIGS. 4 and 5, and reference also to FIGS. 8–11, the recovery tank and nozzle assembly 18 includes a recovery tank 120. The recovery tank includes a basin portion 122 and an upper portion 124 which are sealed together by glueing, sonic welding, or other conventional means, to define an internal chamber 126 for collecting recovered dirty cleaning solution.

An exterior forward region of the upper portion 124 and basin portion 122, when joined, defines a depressed zone 128. When the recovery tank and nozzle assembly is positioned in the socket 100, the depressed zone extends forward of the lower housing portion 22 and the brushroll cavity 64, such that a perforated lip 130 at a lower end of the depressed zone is positioned adjacent the floor surface. A detachable nozzle cover 134 cooperates with the depressed zone to form a suction nozzle flowpath 138 having an elongated inlet slot or nozzle 140 extending laterally across the width of the nozzle cover and an outlet 142 at an upper end of the flowpath 138. Specifically, the nozzle cover is removably connected to the recovery tank 120 by screws, bolts or other suitable fasteners located adjacent upper and lower ends of the nozzle cover. Alternatively, the nozzle cover could be adhered to the recovery tank by glue or sonic welding.

Figure 8:
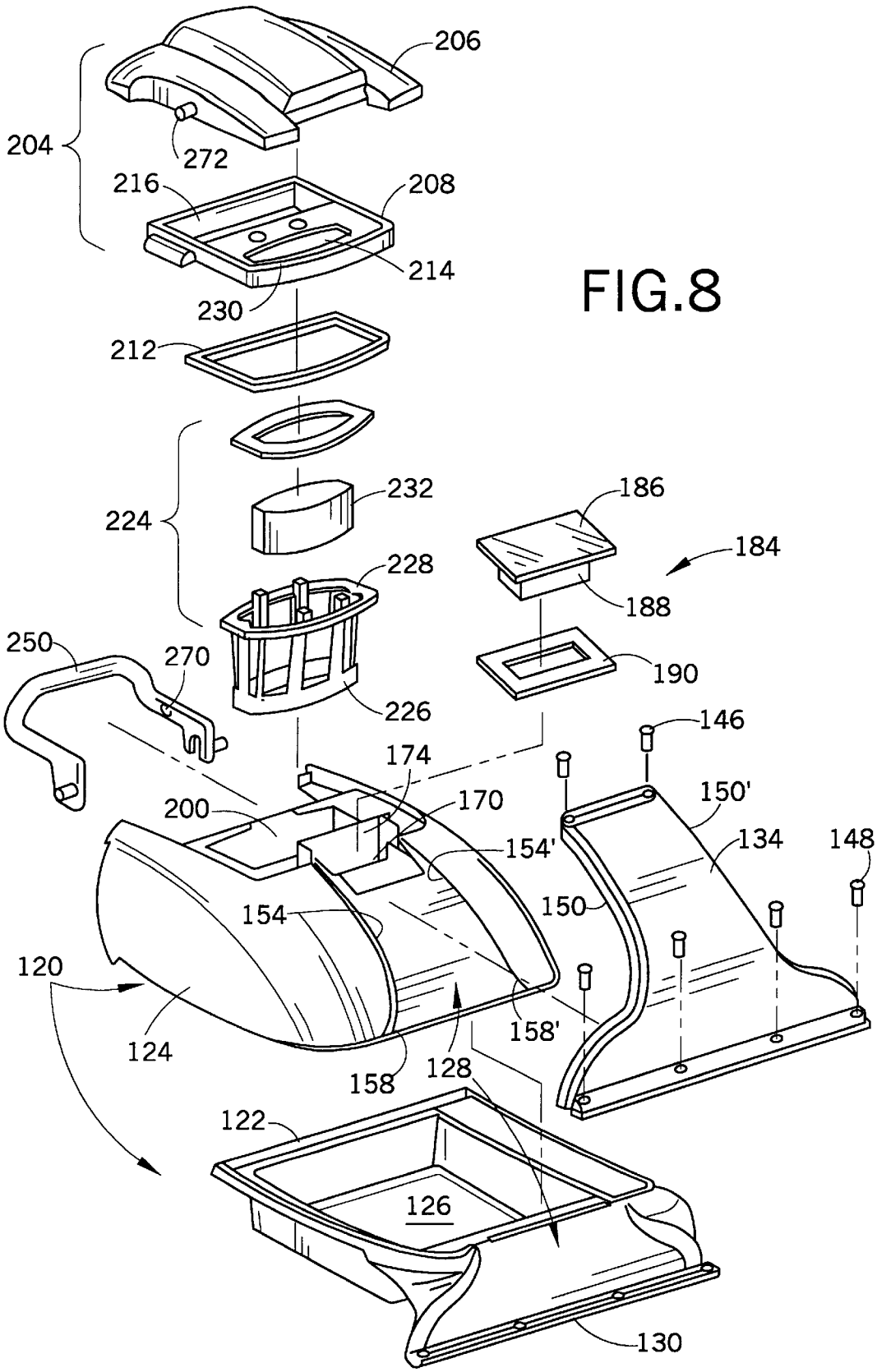
FIG. 8 is a reduced exploded perspective view of the recovery tank and nozzle assembly of the base assembly of FIG. 4.

As shown in FIG. 8, two screws 146 attach the upper end of the nozzle cover to the upper portion 124 of the recovery tank, while four, similar screws 148 attach the lower end of the nozzle cover to the lower lip 130 of the basin portion 122. Peripheral edges 150 and 150' of the nozzle cover 134 sealingly engage adjacent peripheral edges 154 and 154' of the depressed zone. A pair of sealing members, such as gaskets 158 and 158', are disposed between each of the peripheral edges of the nozzle cover and the depression, and assist in providing an airtight seal. Alternatively, the peripheral edges of the nozzle cover are sealed to the corresponding peripheral edges of the depressed zone with an adhesive. The nozzle cover 134 and the depressed zone 128 are formed from a transparent material, such as a conventional thermoplastic, which allows an operator to check that the flowpath 138 is suctioning dirt and cleaning fluid effectively and to ensure that the brushroll 60 is rotating.

Figure 10:
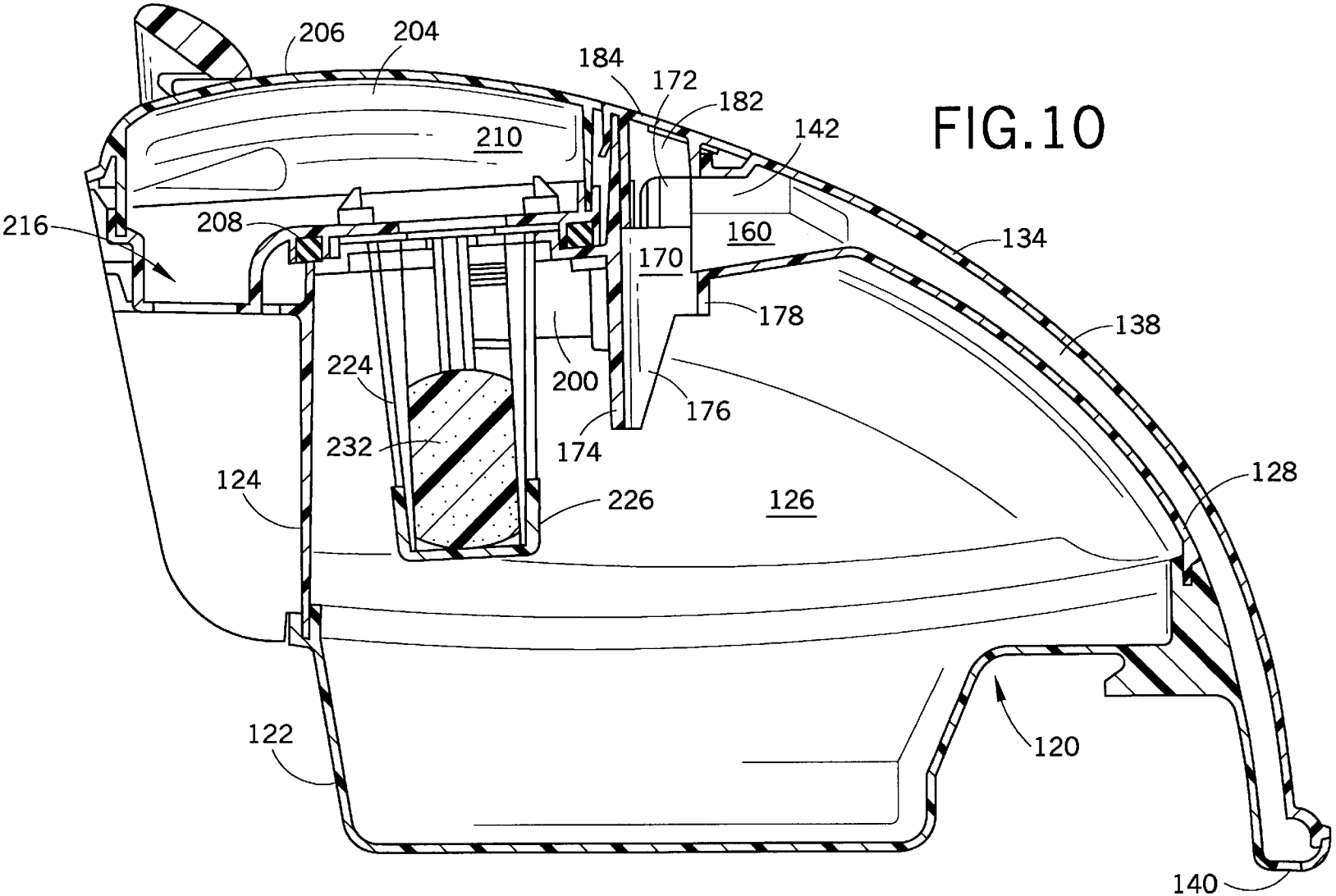
FIG. 10 is a side sectional view of the recovery tank and nozzle assembly of FIG. 8.

Dirt and cleaning solution from the floor surface to be cleaned are drawn through the nozzle inlet slot 140 into the suction flowpath 138. As shown in FIG. 10, the flowpath widens into an exit chamber 160 adjacent the upper end of the nozzle cover 134. A recovery tank inlet slot 170, integrally formed with the recovery tank upper portion 124, extends vertically into the recovery tank interior chamber 126. An opening or inlet 172 is defined in an upper end of the inlet slot 170. The opening communicates directly with the nozzle exit chamber 160. The slot has a vertically extending planar rear wall 174, which is oriented perpendicularly to the adjacent exit chamber and outlet 142 of the nozzle flowpath, and a lower outlet 176.

The recovery tank inlet slot 170 acts as an air-fluid separator. The dirt, cleaning solution, and working air enter the recovery tank through the opening 172. The rear wall 174 of the inlet slot directs the recovered cleaning solution and working air through a roughly 90-degree angle, as shown by arrow B in FIG. 4, and downward into the recovery tank where the recovered solution and dirt are collected in the interior chamber 126. The contact of the recovered solution with the rear wall 174 assists in separating the cleaning solution from the working air. It also prevents liquid from traveling directly toward an outlet of the chamber 126. A forward wall 178 of the inlet slot 170 extends generally parallel with the rear wall 174, but is shorter in length, allowing working air to enter the recovery tank without passing through the accumulated dirty cleaning solution in the chamber 126. Since the air has to turn an additional 90 degrees, any remaining liquid in the air stream tends to precipitate out.

An upper end 182 of the opening 172 is closed during floor cleaning by a removable inlet slot cover 184 so that all the air and recovered solution entering the nozzle flowpath 138 is directed into the recovery tank chamber 126. The inlet slot cover includes a horizontal top portion 186 and a wall 188, shaped to fit through the opening upper end 182, which extends vertically from a lower surface of the top portion. A sealing member 190, such as an annular gasket, is preferably received around the wall 188 to seal the inlet slot cover around the opening upper end. Optionally, a flexible tag (not shown) connects the inlet slot cover 184 with an exterior surface of the recovery tank 120 so that the cover is not misplaced during above the floor cleaning.

A discharge opening 200 is defined in the upper portion 124 of the recovery tank 120 for emptying the collected dirty cleaning solution and dirt from the interior chamber 126. As mentioned, the rear wall 174 of the inlet slot prevents direct flow of liquid to the discharge opening 200 of the recovery tank. During operation of the extractor, the discharge opening is sealed by a removable hollow lid 204. The lid 204 includes an upper wall 206, which forms an exterior of the lid, and a lower wall 208. The upper and lower walls are glued together to define an interior discharge chamber 210. A sealing member, such as a gasket 212, seals a lower surface of the lower wall 208 around the discharge opening 200. The lower wall has an inlet 214, which is disposed over the discharge opening 200 when the lid is in place, and an outlet 216, which is disposed over the vertically extending upper portion 90 of the inlet chamber, defined by the motor cover 28, through which the discharge chamber communicates with the fan 82. Working air is sucked upward from the recovery tank 120 by the motor and fan assembly 20, drawn through the discharge chamber inlet 214 into the discharge chamber 210, and is directed through an almost 180-degree turn by the lid upper wall 206. The working air travels downward through the discharge chamber outlet 216 into the motor cover upper portion 90 of the inlet chamber 88. When the lid 204 is seated on the recovery tank, the lower wall 208 partially covers an upper end of the front hood 26. As shown in FIG. 5, the front hood provides an air access opening 220 to the motor cover upper portion 90 of the inlet chamber 88.

The positioning of the recovery tank 120, lid 204, and motor and fan assembly 20 provides a low profile extractor base assembly A, while maintaining a sizeable capacity for the recovery tank. This allows the base assembly to be wheeled under chairs, beds, and other household furniture or obstructions.

With continued reference to FIGS. 4, 8, and 10, fastened to the lid 204 is a float cage assembly 224. The float cage assembly 224 is removable from the recovery tank 120 along with the lid for ease of emptying the recovery tank and for cleaning of the float cage assembly. Specifically, the float cage assembly 224 includes a float cage 226. The cage is attached to the lower wall 208 of the lid by a number of tangs 228, which slot into corresponding openings 230 defined in the lower wall 208 around the lower wall inlet 214. A float 232 is received within the float cage. The float chokes off the flow of working air through the recovery tank chamber 126 when the reclaimed solution in the recovery tank reaches a predetermined level. A filter cup 236 is optionally received around the float cage for filtering particles of dirt from the working air (See FIG. 4). The filter cup is preferably formed from a porous material, such as plastic or foam, which is readily washable or replaceable to prevent the filter from becoming clogged with dirt. Prior to entering the discharge chamber 210 from the recovery tank 120, therefore, the working air passes through the filter cup 236 and the float cage 226 as shown by arrow C.

With particular reference to FIG. 4, the lower housing portion 22 defines an exhaust chamber 238 at the base of the fan housing compartment 78. The working air leaves the fan housing compartment through the exhaust chamber in the direction of the floor surface through exit slots 240 defined in the plate 96, as shown in FIG. 5.

Louvers 242 (shown in FIG. 7), formed in a rear end of the base housing 10 provide an air inlet for drawing in cooling air for cooling the fan motor 80. Preferably, a cooling fan 246, connected to a rear of the motor 80 is rotated by the motor to circulate air around the fan motor. Exhaust of air is through louvers 248.

Figure 9:
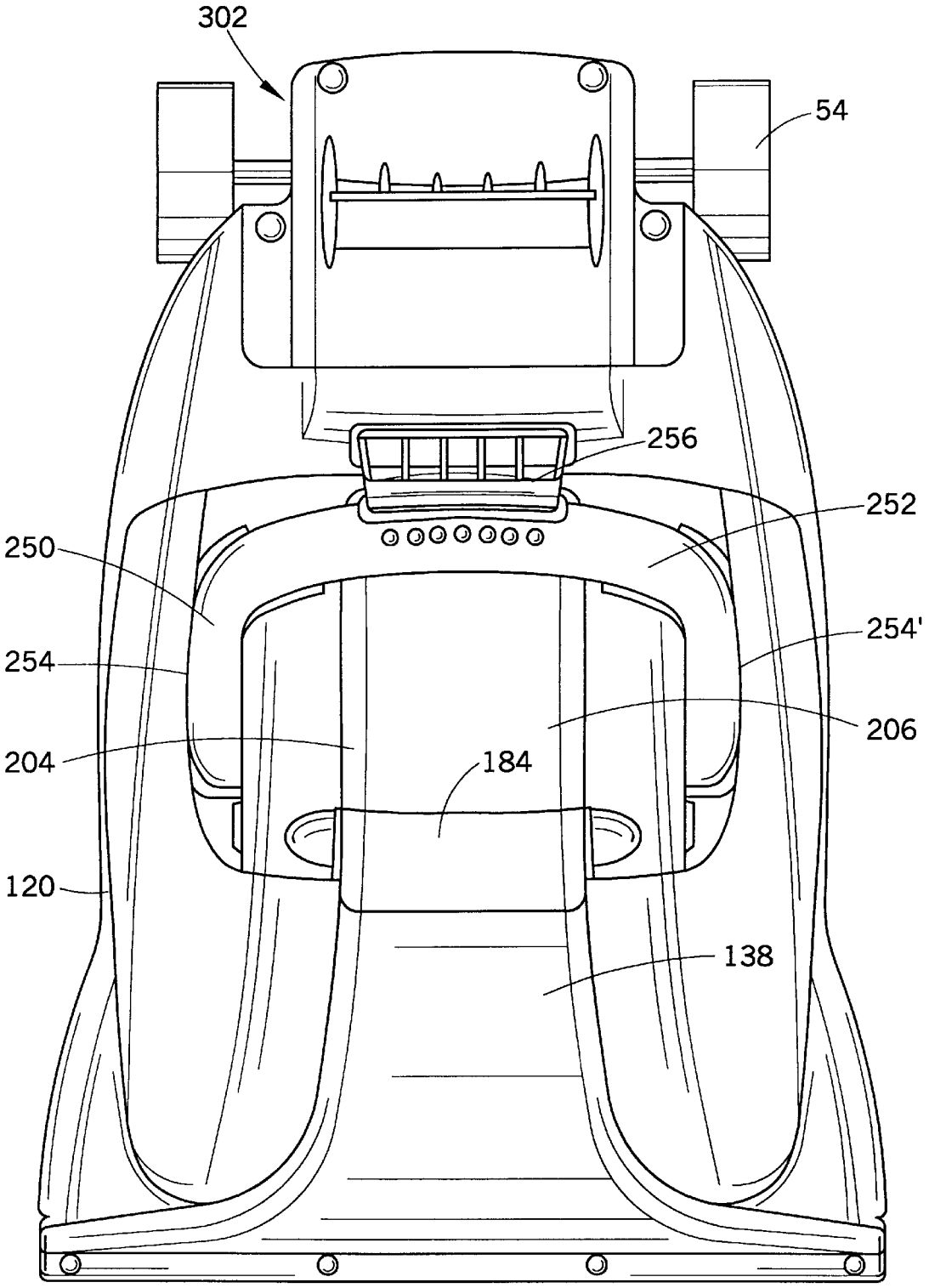
FIG. 9 is a top plan view of the carpet extractor of FIG. 1 with the directing handle assembly removed for clarity.
Figure 11A:
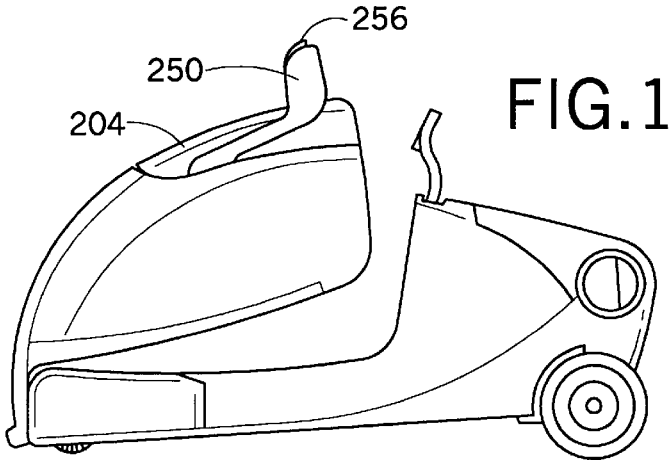
FIGS. 11A, 11B, and 11C are side elevational views of the base housing, recovery tank, and carrying handle of FIG. 1, showing the handle in an unlocked position, a carrying position, and an emptying position, respectively.
Figure 11B:
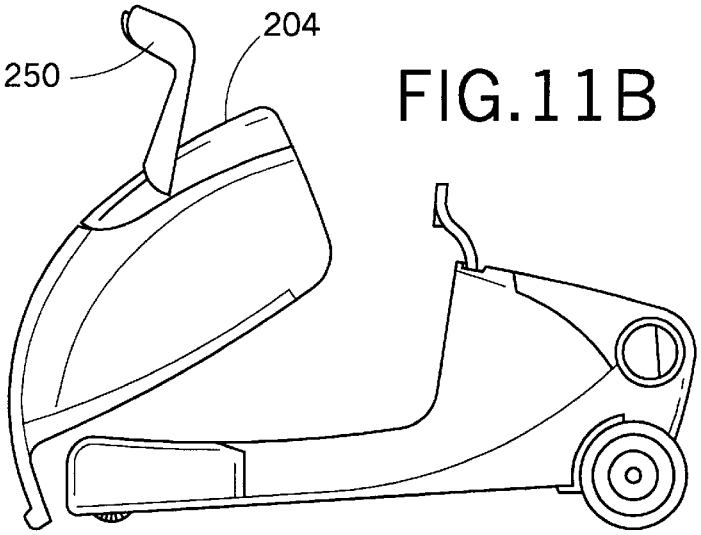
Figure 11C:
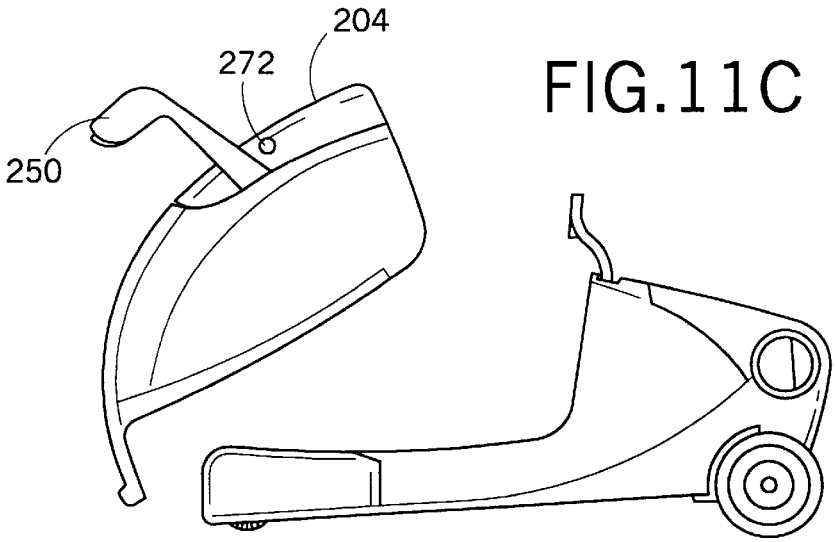

With reference to FIGS. 4, 9, and 11, the recovery tank 120 includes a carrying handle 250 which is movable between a first functional position, or locking position (shown in FIGS. 9 and 11A), in which the recovery tank is lockable to the base housing 10, a second functional position, or carrying position (shown in FIG. 11B), in which the recovery tank is removable from the base housing 10 and the lid 204 is locked to the recovery tank, and a third functional position, or emptying position (shown in FIG. 11C), in which the lid is removable from the recovery tank for emptying the recovery tank. Specifically, the carrying handle 250 includes a central, U-shaped portion 252 defined between two laterally-spaced end portions or legs 254 and 254'. The legs 254 and 254' are pivotally connected to the upper portion 124 of the recovery tank.

In the locking position, the handle lies adjacent to the recovery tank and upper wall 206 of the lid to maintain the sleek, low profile of the base assembly A. In the locking position, the legs lie generally horizontally. The central portion 252 includes a rearwardly extending engagement tab 256, best shown in FIG. 4. A latching member 258 is received in a vertically extending slot 260 in the rear cosmetic cover 30 so that it extends upwardly from the cosmetic cover 30, rearward of the lid. Specifically, the latching member is pivotally connected at a lower end to the base of the slot at two laterally spaced pivot points 262. A V-shaped biasing member 266, received in the slot 260 rearward of the latching member, biases the latching member to a forward position. The latching member defines a tang 268 which engages the tab 216 on the carrying handle 250, when the latching member is in the forward position, to lock the recovery tank 120 to the base housing 10. To release the tab from engagement, the latching member is pivoted rearwardly, allowing the recovery tank carrying handle 250 to be pivoted forwardly into the carrying position.

In the carrying position, the lid 204 is held in position on the recovery tank 120 to avoid spillage of recovered cleaning solution during transportation of the recovery tank. Specifically, hooks 270, one on each of the carrying handle end portions 254 engage corresponding projections 272 on the lid top wall 206 when the carrying handle is in the carrying position. The engagement of the hooks with the projections inhibits removal of the lid. To empty the recovery tank, the carrying handle 250 is pivoted further forward to the emptying position, releasing the projections from engagement with the hooks. The lid can then be removed from the recovery tank.

One or more tangs 274 (see FIG. 6), mounted on a forward end of the lower housing portion 22, engage the lip 130 of the nozzle inlet slot 140, causing the recovery tank and nozzle assembly 18 to pivot around the tangs during removal, as shown in FIGS. 11A, B, and C. The recovery tank and nozzle assembly is moved forwardly during pivoting to disengage the assembly from the tangs.

Figure 12:
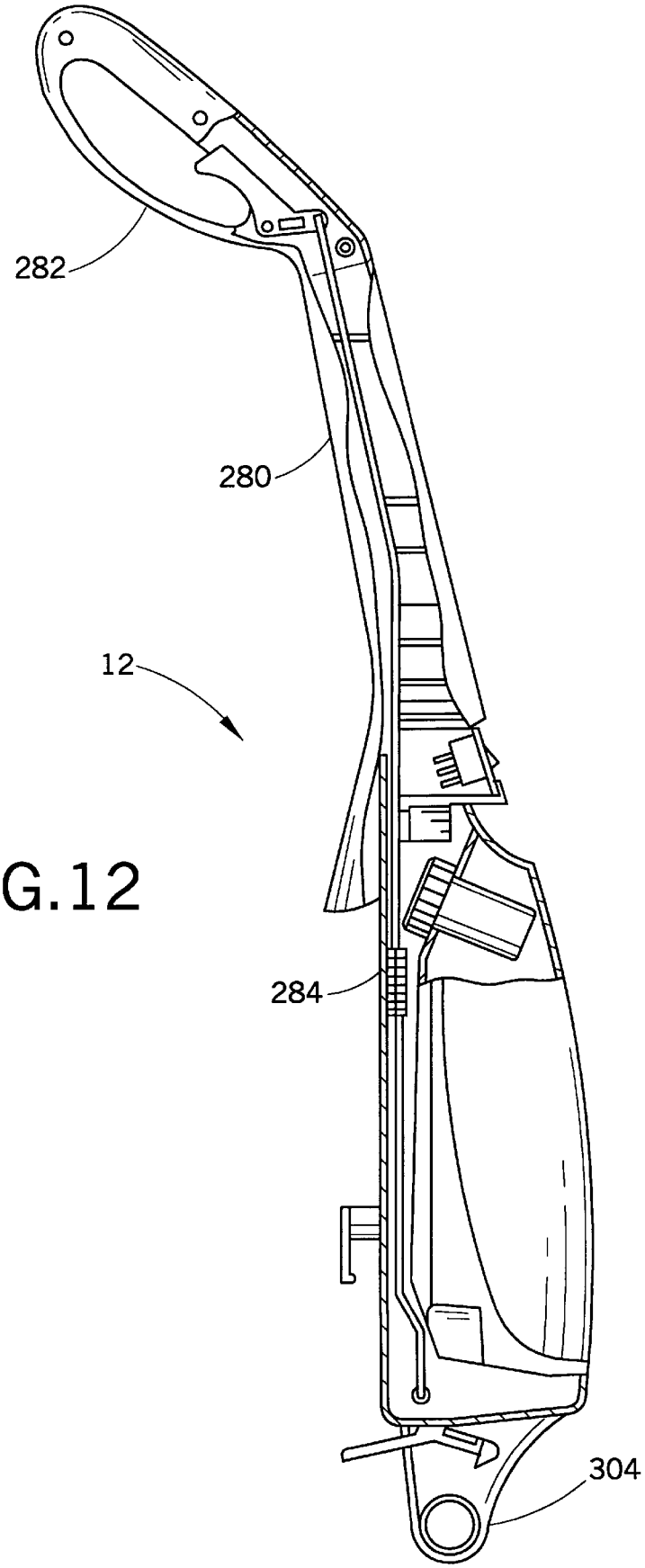
FIG. 12 is an enlarged side sectional view of the directing handle assembly of the extractor of FIG. 1.
Figure 13:
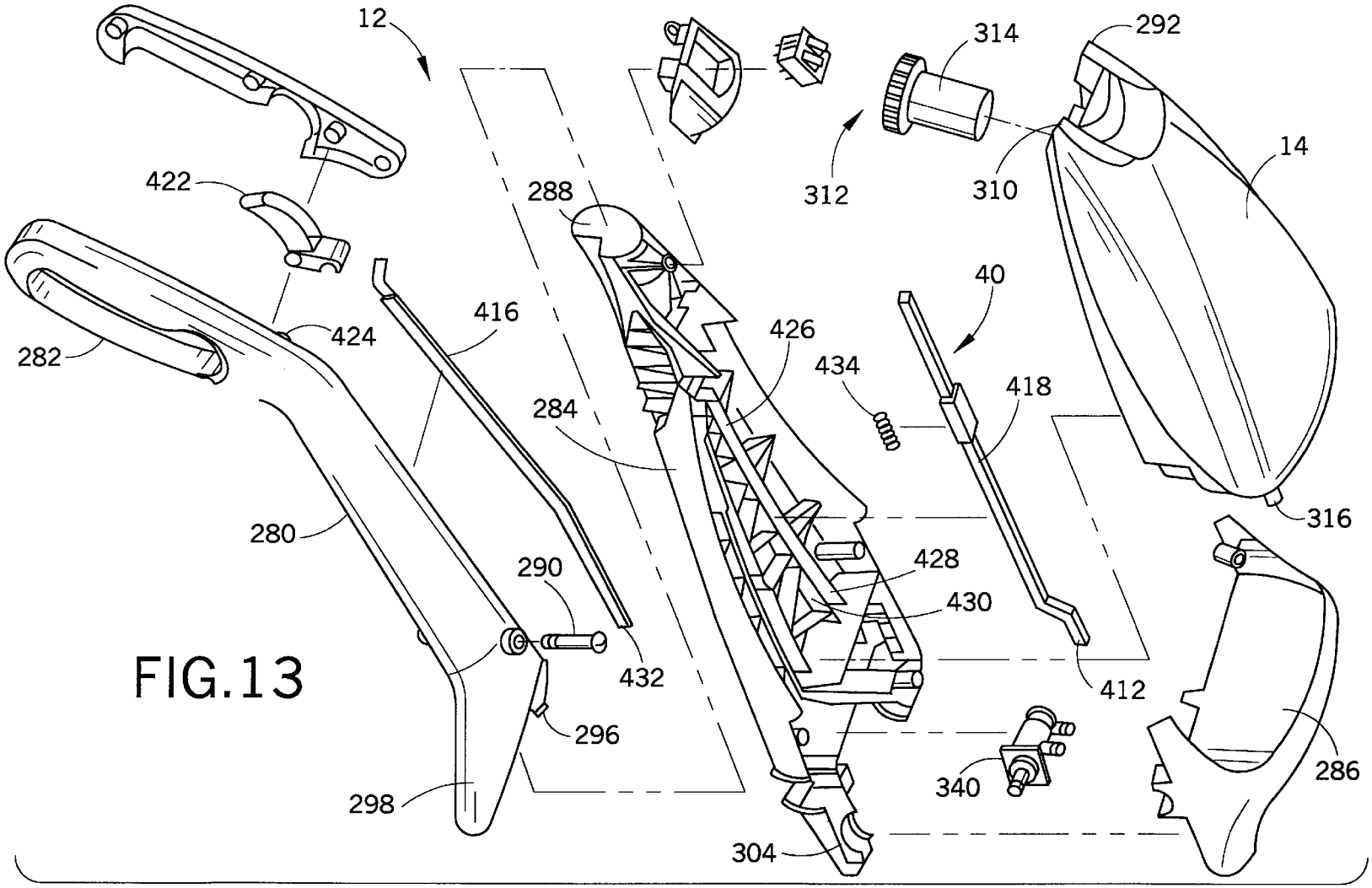
FIG. 13 is an exploded perspective view of the directing handle assembly and cleaning solution reservoir of the extractor of FIG. 1.
Figure 14:
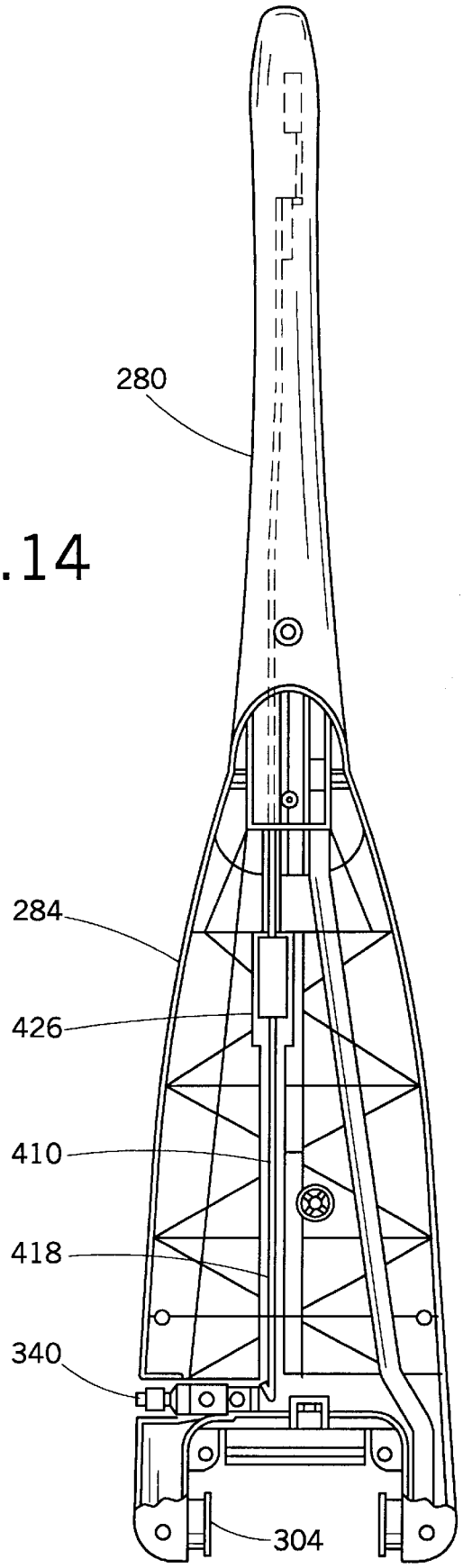
FIG. 14 is an enlarged front elevational view of the directing handle assembly of FIG. 13.

With reference to FIGS. 12–14, the directing handle assembly 12 includes an upper handle portion 280, which defines a hand grip 282 at its upper end, and a lower handle portion or body shell 284. A cleaning solution reservoir support shelf 286 extends horizontally forwards from adjacent a lower end of the body shell 284 for supporting the cleaning solution supply tank 14. The body shell is shaped to receive a rear portion of the cleaning solution supply tank. The directing handle assembly is completed by fixedly attaching the upper handle portion to the lower body shell by telescopingly sliding the upper handle downward over an attachment post 288 defined by an upper end of the body shell 284. The upper handle is secured to the attachment post by a screw 290, pins, or other suitable fasteners.

Figure 24:
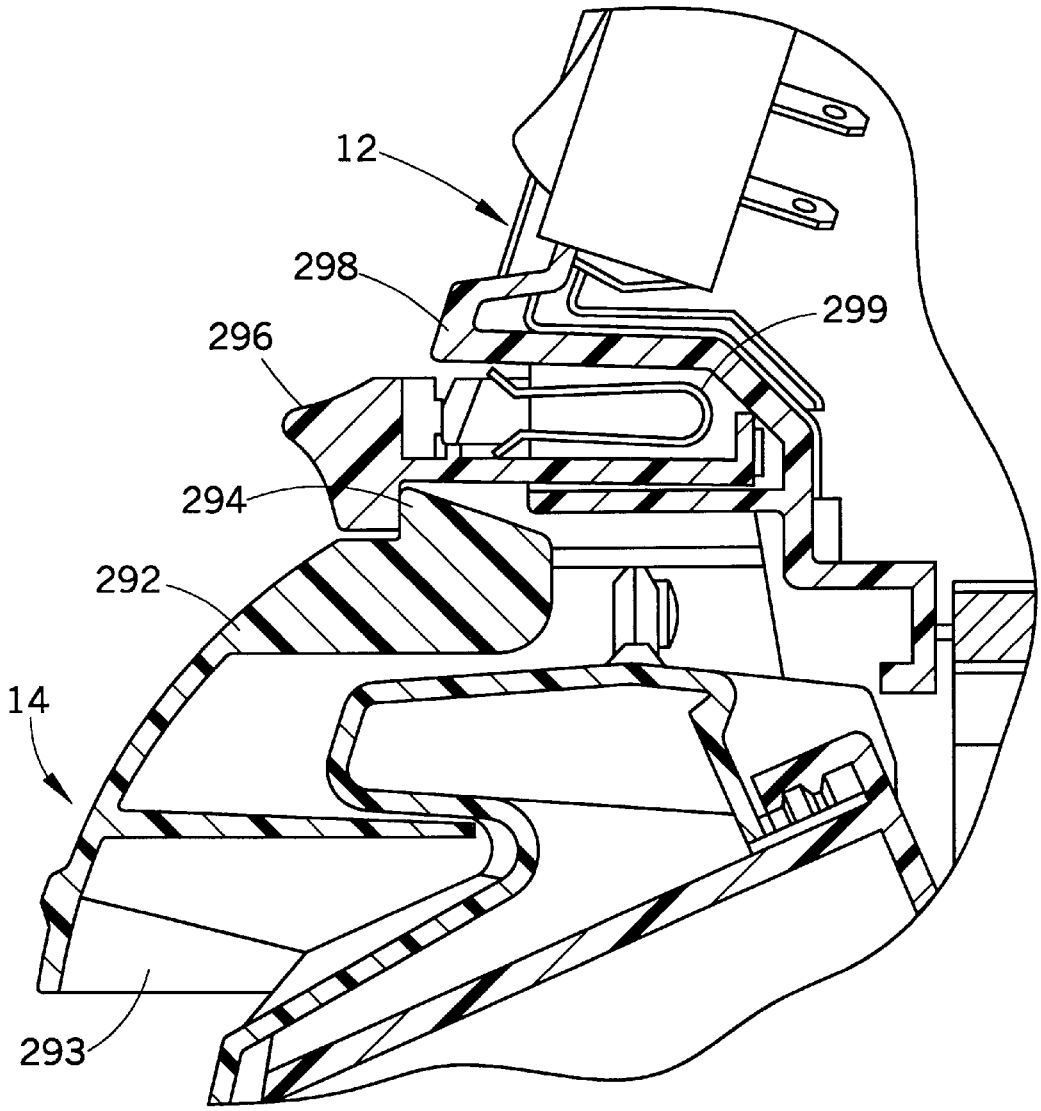

The supply tank 14 includes a carrying handle 292 mounted to an upper end of the tank, shown in FIG. 13 and in more detail in FIG. 24. The handle includes a downward-facing slot 293 which receives the fingers of an operator's hand for transporting the reservoir. To latch the supply tank 14 in position on the directing handle assembly 12, a catch 294 on the supply tank carrying handle 292 is engaged with a resiliently flexible latch 296 disposed on an outwardly extending lower end 298 of the upper handle portion. A biasing member 299 biases the latch to an engaged position. To release the reservoir, the operator presses upwardly on the latch to move the latch to a disengaged position and withdraws the reservoir from the handle assembly.

Together, the body shell 284 and the base housing 10 thus comprise an extractor housing 300 which supports the main components of the extractor, including the recovery tank and nozzle assembly 18, supply tank 14, brushroll 60 and brushroll motor 68, motor and fan assembly 20, and the like.

As shown in FIG. 2, the directing handle assembly 12 is pivotally connected to the base housing 10 for movement between an upright position and a working position (shown in phantom). Specifically, the rear of the base assembly has laterally spaced integrally molded trunnions 302 (FIG. 5) for rotatingly receiving thereon spaced pivoting members 304 (FIG. 14) on the lower handle portion. As is evident from FIG. 1, the recovery tank and nozzle assembly 18 is removable from the base assembly A even in the upright position of the directing handle assembly 12, facilitating emptying of the recovery tank 120. In other words., the recovery tank and nozzle assembly can be lifted vertically by its carrying handle 250 and clears the cleaning fluid tank 14 and the directing handle assembly 12.

Near the top of the cleaning solution supply tank 14 is a fill opening 310 through which the tank may be conveniently filled with cleaning solution as shown in FIG. 13. A cap 312 sealingly closes the fill opening. The cap includes an inverted cup portion 314 which serves as a convenient measuring cup for mixing an appropriate amount of a concentrated cleaning fluid with water in the supply tank. The cleaning fluid is poured into the tank and the cap is then inverted to seal the fill opening 310.

Figure 15:
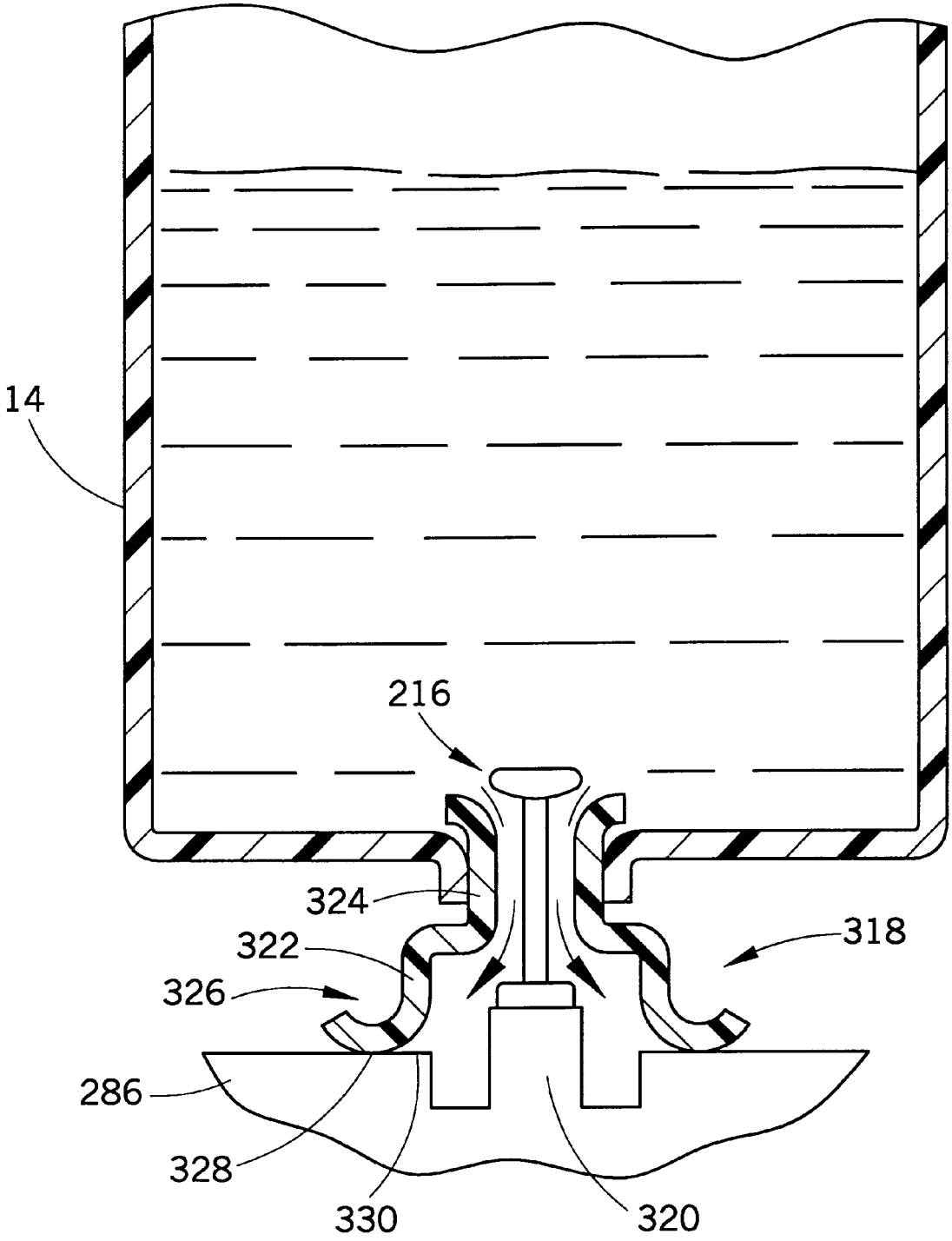
FIG. 15 is a greatly enlarged front sectional view of the cleaning solution reservoir of FIG. 13 showing a check valve thereof.

With reference also to FIG. 15, at the base of the cleaning solution supply tank 14 is a cleaning solution outlet 316. A check valve 318 closes off the outlet during transport of the tank 14. A reservoir valve actuator 320 opens the check valve 318 when the tank is seated on the support shelf 286. A grommet 322, formed from a resilient, flexible material, such as rubber, serves to seal the valve 318 to the cleaning solution tank outlet 316 and to seal around the valve actuator 320. Specifically, the grommet includes a cylindrical portion 324 which is seated in the outlet 316 and a skirt portion 326, which extends downwardly and outwardly from the cylindrical portion, to form an annular sealing surface 328 which seals against a corresponding surface 330 of the valve actuator.

Figure 16:
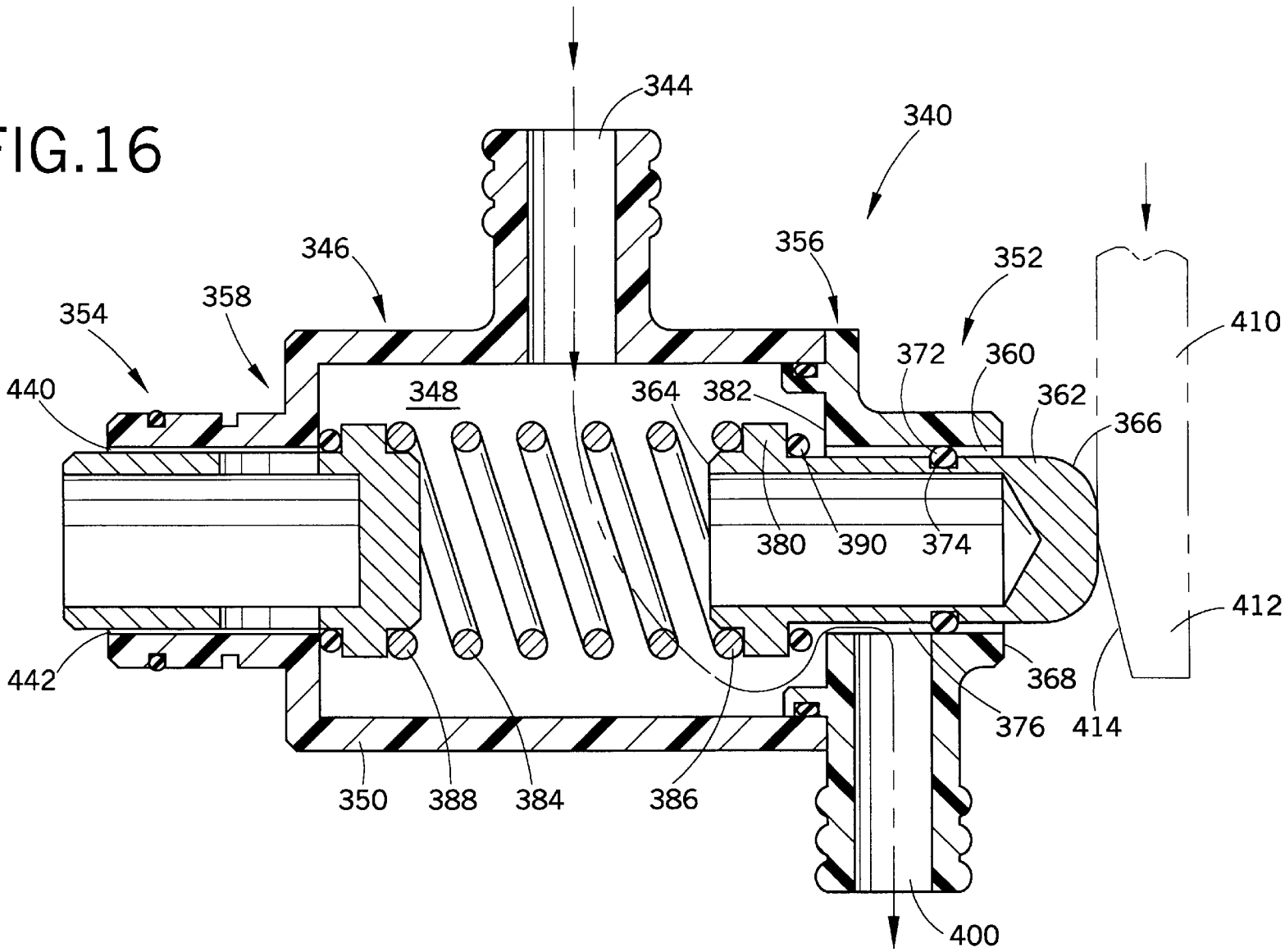
FIG. 16 is a greatly enlarged side sectional view of a directional valve assembly of FIG. 1 shown with a first discharge port open.
Figure 17:
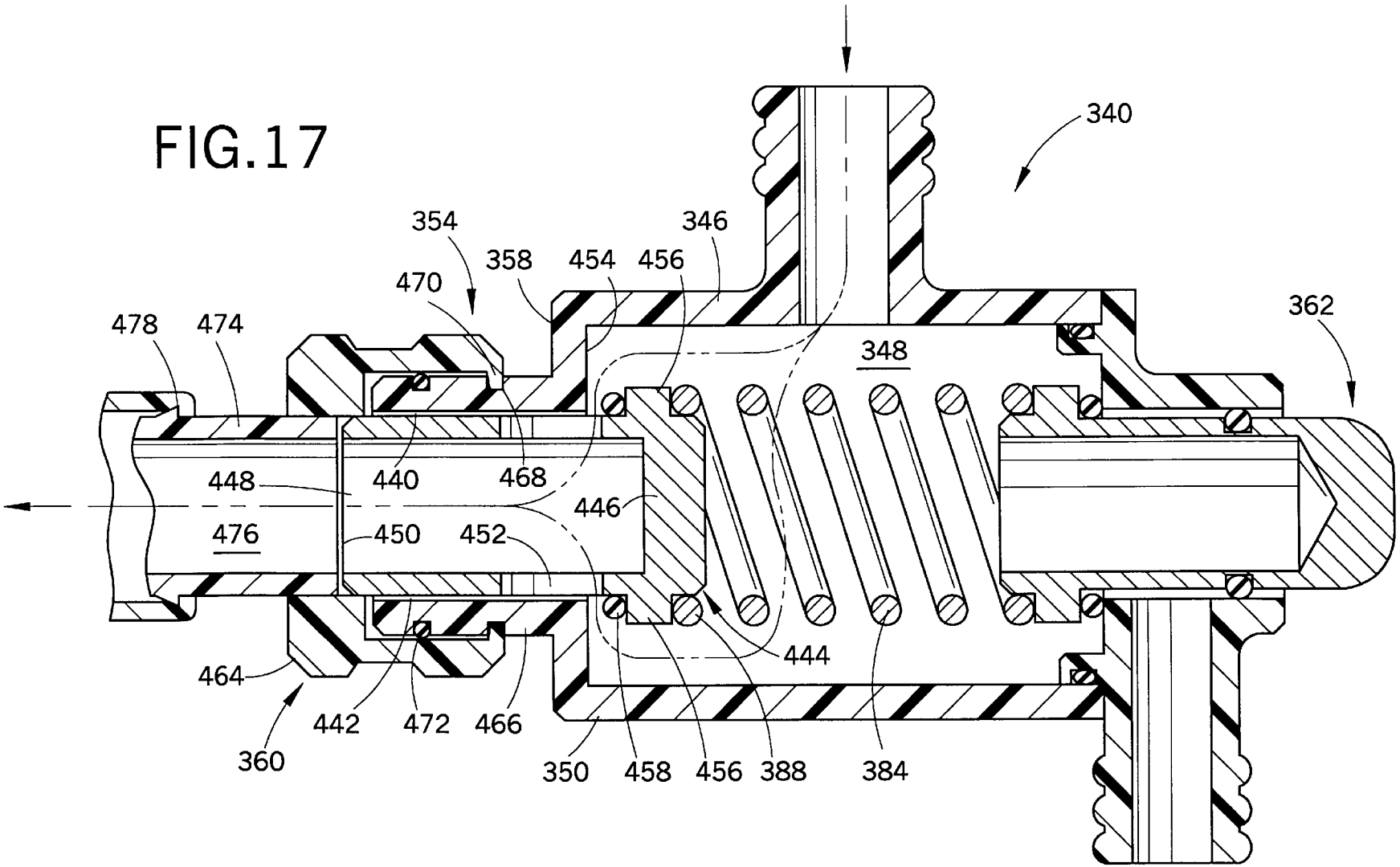
FIG. 17 is a side sectional view of the valve assembly of FIG. 16 shown with a second discharge port open.

With reference now to FIGS. 14 and 16–17, the outlet 316 is fluidly connected to a valve assembly, or combination port valve 340. The valve assembly 340 directs the cleaning solution to the drool/spray bar 74 for floor cleaning, or to the accessory tool 16, for cleaning remote surfaces, such as stairs and upholstery. The valve assembly is preferably supported by the body shell 284, beneath or adjacent to the cleaning solution supply tank 14, as shown in FIG. 13, although other locations for the valve assembly, such as in the base assembly A, are also contemplated.

Figure 18:
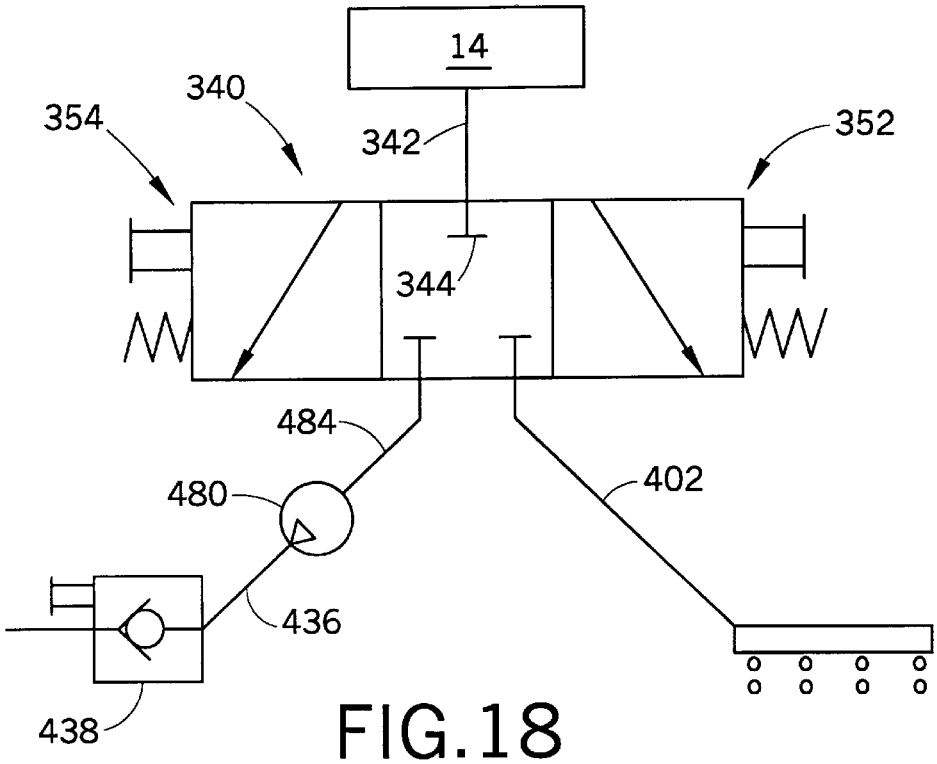
FIG. 18 is a schematic view of a fluid control circuit of the extractor of FIG. 1 according to a first preferred embodiment of the present invention.

In a first embodiment, shown schematically in FIG. 18, a hose 342 is connected between the cleaning solution supply tank and an inlet port 344 of the valve assembly 340. The cleaning solution flows under gravity from the supply tank 14 to the valve assembly 340. In a second embodiment, shown schematically in FIG. 19, and discussed in detail later, the cleaning solution is pumped under pressure to the valve assembly. In both embodiments, the valve assembly is structurally the same, it is only the components of the extractor that are coupled with the valve assembly that differ.

With reference once more to FIGS. 16, 17, and 18, the valve assembly 340 includes a valve housing 346 with an interior chamber 348. The housing chamber includes a cylindrical body portion 350, into which the inlet port 344 opens. The valve assembly 340 includes first and second valve members or discharge valves 352 and 354, respectively, which selectively open to release cleaning solution to the drool/spray bar 74 or to the accessory tool 16, respectively. The first and second valve members are disposed on first and second ends 356 and 358, respectively, of the cylindrical body portion 350.

The first valve member 352 is fluidly connected with the drool/spray bar 74 and includes a cylindrically shaped first valve bore 360, defined by the valve housing 346 and extending axially from the first end 356 of the body portion, and a cylindrical first valve stem or poppet 362. The first poppet is positioned within the housing chamber 348 for sealing the first valve member 352. Specifically, the first poppet is slidingly received in the valve bore such that a first, open inner end 364 of the first poppet extends into the body portion 350 of the valve assembly and a second, outer closed end 366 protrudes from a distal end 368 of the first valve bore 350, so that it extends beyond the valve housing 346. A first circumferential seal 372, such as an O-ring, is positioned in a circumferential groove 374, located in an outer surface of the first poppet adjacent the distal end 368 of the valve bore. The seal 372 seals the first poppet to the first valve bore to define an annular space 376 between the first poppet 362 and the first valve bore 360, which is sealed from the exterior.

A first circumferential flange 380 extends radially from the inner end 364 of the first poppet 362 into the body portion 350 of the valve assembly. The first valve bore 360 is narrower than the cylindrical body portion 350 such that an annular first valve seat 382 is defined by a stepped portion between the first end 356 of the body portion and the first bore 360. A compression spring 384, having first and second ends 386 and 388, respectively, is disposed axially in the body portion 350 of the chamber. The first end 386 of the spring engages the inner end 364 of the first poppet 362, biasing the first flange 380 toward the first valve seat 382. A second circumferential seal 390, such as an O-ring, is positioned on the first poppet 362 between the first flange 380 and the first valve seat 382. In the normally closed position, the pressure of the spring compresses the second seal 390 between the first flange 380 and the first valve seat 382, sealing the body portion 350 of the valve assembly from the annular space 376 between the first valve bore 360 and the first poppet 362.

The housing 346 defines a first discharge port 400 which opens into the annular space 376, between the first and second seals 372 and 390. The first discharge port is fluidly connected to the drool/spray bar 74 by a hose 402, shown schematically in FIG. 18. As shown in FIG. 6, the hose is supported by a channel 404 which runs along one side of the base housing 10. To separate the fluid lines of the extractor from the electrical components of the base A, a wall 406 of the rear cosmetic cover 30 is seated on the motor cover 28 (as shown in FIG. 5), forming a barrier between the fluid lines, such as hose 402, and the electrical wiring for the fan motor 80, brushroll motor 68, and other electrical components of the base assembly.

To open the first valve member 352, and allow cleaning solution to pass from the body portion 350 and out through the first discharge port 400, the first poppet 362 is pushed inwardly, toward the body portion by a valve actuator. A preferred actuator is a generally vertically extending actuation rod or push rod 410, which is positioned with a tapered lower end 412 located adjacent the closed outer end 366 of the first poppet. The lower end 412 of the rod defines a camming surface 414. When the actuation rod 410 is pushed downwards, the camming surface 414 engages the outer end 366 of the poppet, pushing the first poppet inwards against the biasing force provided by the compression spring 384. The flange 380 is thereby disengaged from the valve seat 382, providing a passageway between the chamber 348 and the first discharge port 400, through which the cleaning solution flows under gravity, as shown in FIG. 16.

Although FIG. 16 shows the first discharge port 400 as being located vertically opposite the inlet port 344, it should be appreciated that the inlet port and the first discharge port could equally extend from the valve housing in other directions. As shown in FIGS. 13 and 14, the inlet port and the first discharge port extend forwardly and parallel to each other.

With reference once more to FIGS. 12–14, the actuation rod 410 comprises an upper portion 416 and a lower portion 418. The upper portion of the rod is received within the upper portion 280 of the directing handle assembly, and is pivotally connected at an upper end to a trigger 422. The trigger is pivotally connected to the handle grip 282 at a pivot point 424. By squeezing the trigger 422 toward the handle grip, the upper portion 416 of the actuation rod is moved downwardly. The lower portion 418 of the actuation rod is received in a central channel 426 in the body shell, defined by two parallel spaced walls 428 and 430. A lower end 432 of the upper portion 416 of the actuation rod is positioned such that it pushes the lower portion 418 of the rod downwards when the trigger 422 is gripped. The lower portion of the actuation rod includes a compression spring 434 which biases the actuation rod upwardly when pressure on the trigger is released.

Figure 3:
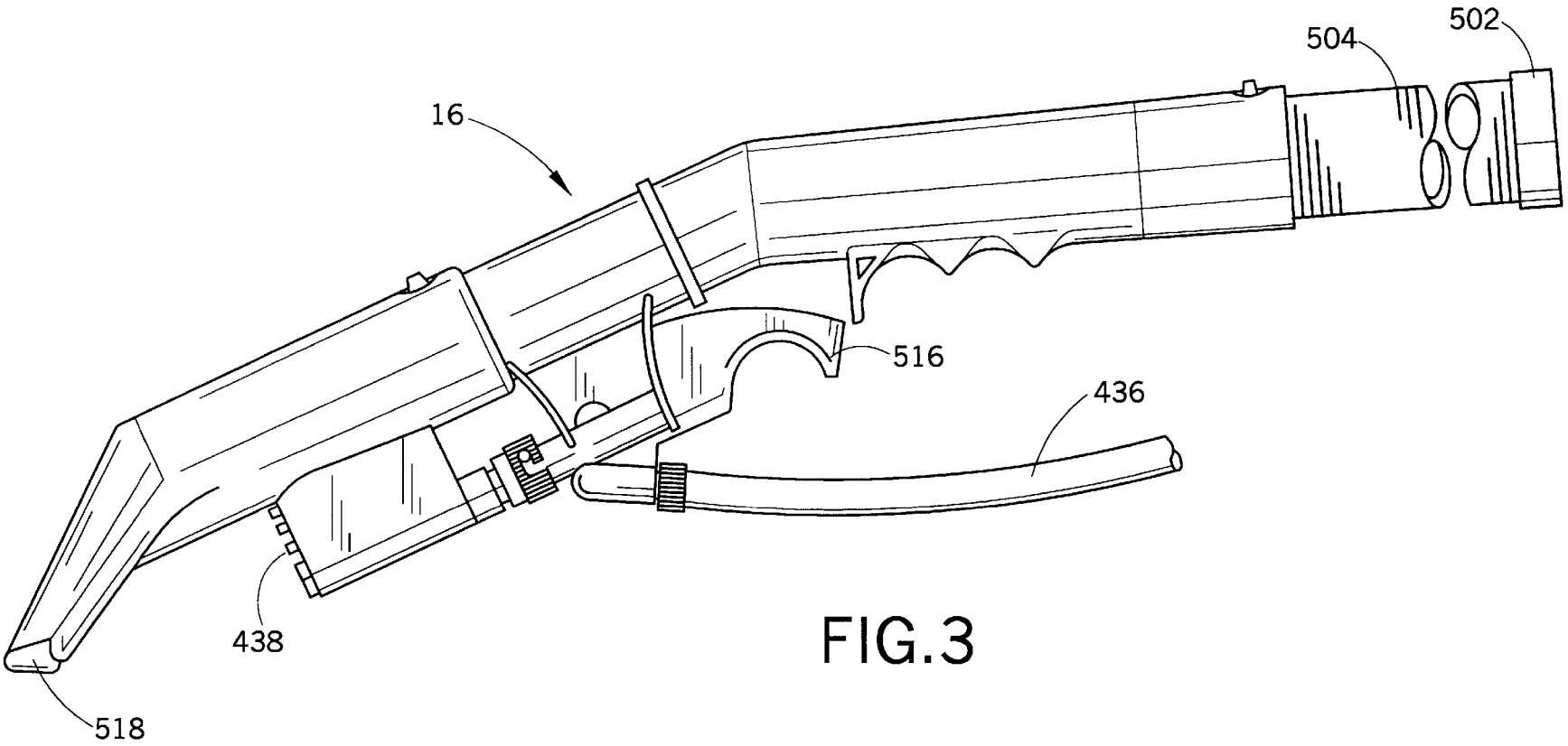
FIG. 3 is a side elevational view of a carpet extractor accessory tool for above floor cleaning, according to the present invention.

With reference also to FIGS. 3, 17, and 18, the accessory tool 16 includes a solution supply hose 436 for delivering cleaning solution to a remote distributor 438. The second valve member 354 of the valve assembly is fluidly connected with the accessory tool supply hose when the tool is to be used. The second valve member defines a cylindrical internal bore 440 which extends axially from the second end 358 of the body portion and defines a second discharge port 442 at an outer end. A second cylindrical valve stem or poppet 444 is received in the housing 346 for selectively closing the second valve member. Specifically, the bore 440 slidingly receives the second valve stem 444. An inner, closed end 446 of the second valve stem extends into the body portion 350 of the valve assembly. The valve stem 444 defines a cylindrical internal passageway 448, best shown in FIG. 17, which extends axially along the second valve stem from the closed inner end 446 to an open outer end 450 of the second valve stem, and at least one side opening 452. Preferably, two circular side openings are defined in opposite sides of the second valve stem. A second valve seat 454 is defined by a stepped portion between the body portion 350 and the valve bore 440. A second annular flange 456 extends radially from the second valve stem 444 adjacent the inner end 446. A third compression seal 458, such as an O-ring, is positioned around the second valve stem between the flange 456 and the second valve seat 454. The second end 388 of the compression spring 384 biases the second valve stem 444 and the flange 456 to the normally closed position in which the flange compresses the seal 458 against the second valve seat 454, thereby sealing the valve bore 440 from the body portion 350.

A quick connect coupling assembly 460 releasably connects the second valve member 354 to the accessory tool supply hose 436. Specifically, the accessory tool hose is fluidly connected to a male quick coupling connector 464. An exterior of the housing 346, adjacent the second valve member 354, defines a corresponding female connector 466 which quickly couples with the male connector 464, as best shown in FIG. 17. While one preferred embodiment of the male and female connectors 464,466 is there shown, it should be appreciated that other suitable connectors are also contemplated. In the embodiment shown, the female connector includes a circumferential groove 468 which receives a corresponding circumferential rim 470 of the male connector. An O-ring 472, provides a fluid-tight seal between the male and female connectors.

The male connector 464 includes a valve stem actuator 474 which defines an internal bore 476 and a barb 478 at a distal end for coupling to a solution supply hose. To release cleaning solution from the second discharge port 442, the male coupling 464 is advanced on the female coupling 466. This causes the valve stem actuator 474 to enter the second discharge port 442 and penetrate the second valve bore 440, forcing the closed end 446 of the valve stem 444 into the body portion 350. The opening 452 in the valve stem enters the body portion, providing a fluid path through the body portion, valve stem and valve stem actuator bore 476 to the accessory hose 436.

While the valve assembly 340 has been described with reference to a single compression spring 384 which biases both valve stems 362, 444 to the closed position, alternatively a pair of compression springs may be provided, one for each valve stem. The single compression spring 384 is resilient enough to allow both valve members to be opened contemporaneously, if desired, feeding cleaning solution to both a remote surface and a floor surface.

With reference to FIGS. 3, 18, 20, and 21, in the first embodiment described above, the hose 342 is directly connected between the valve actuator 320 for the cleaning solution tank 14 and the valve assembly inlet port 344 so that cleaning solution flows under gravity from the tank 14 to the valve assembly. A cleaning solution supply pump 480, such as an electric motor-driven peristaltic pump, is coupled between the valve assembly 340 and the accessory tool hose 436 for pumping the cleaning solution to the accessory distributor 438. specifically, a pump hose 484 is connected at one end to the barb 478 of the male quick connect coupling connector 464. The other end of the pump hose 484 is received around a pump inlet fitting 486. The hose 484 may be firmly attached to the inlet fitting or be releasable, to allow for cleaning of the hose. An outlet fitting 488 of the pump is connected to the accessory tool hose 436 and may be similarly affixed or releasable.

Figure 20:
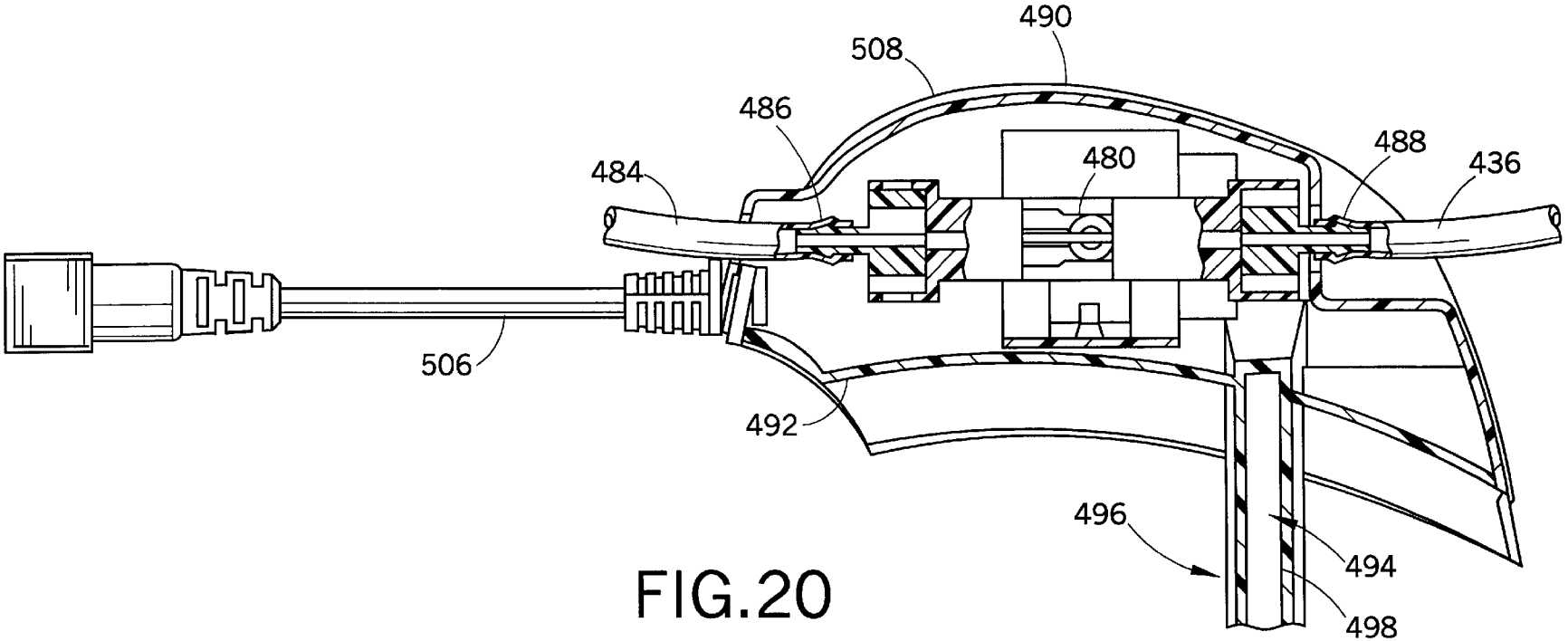
FIG. 20 is a side sectional view of a pump housing and solution supply pump for the embodiment of FIG. 18.
Figure 21:
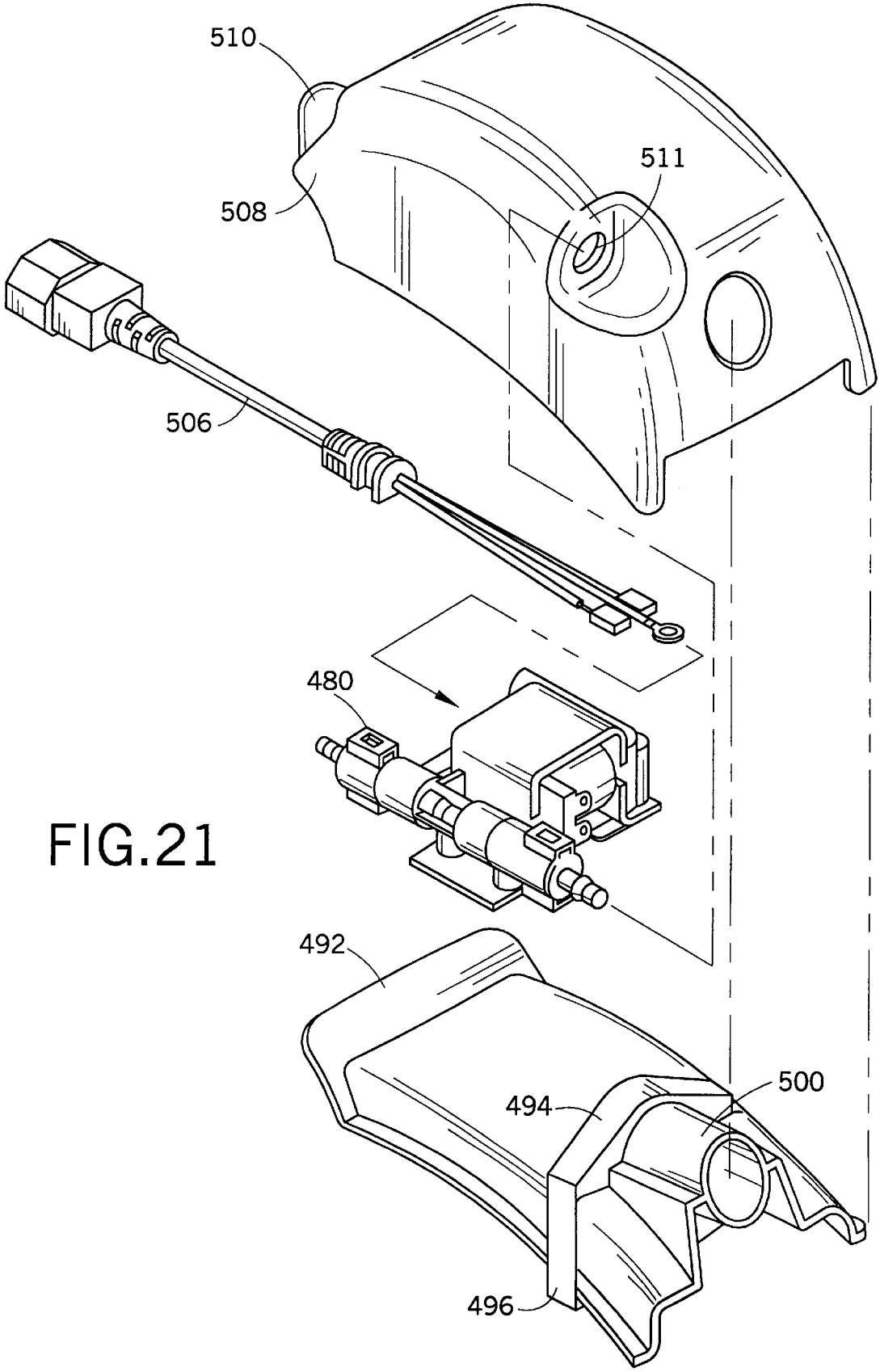
FIG. 21 is an exploded perspective view of the pump housing and pump of FIG. 20.

With particular reference to FIGS. 20 and 21, the pump 480 is preferably enclosed in a two-part pump housing 490 which is removably mounted on top of the base assembly A when the accessory tool 16 is to be used. A lower portion 492 of the pump housing is shaped to be received on top of the recovery tank and nozzle assembly 18. The lower portion defines an L-shaped tube 494 having a vertically extending protrusion 496 which,is received in the upper end 182 of the recovery tank inlet slot 170 via the opening 172. The protrusion 496 of the tube defines a forward wall 498 which closes off the nozzle outlet 142 when the protrusion 496 is inserted into the inlet slot 170. This prevents the motor and fan assembly 20 from drawing working air and cleaning solution through the nozzle flowpath 138. Extending perpendicularly from an upper end of the lower portion of the L-shaped tube is a cylindrical portion 500 which defines an opening for selectively receiving a tubular coupling 502 connected to one end of a vacuum hose 504 of the accessory tool 16. An electrical cable 506 is connected between the pump 480 and the base assembly A when the accessory tool is to be used, to supply power to the pump.

An upper portion 508 of the pump housing 490 defines two openings, namely a rearward opening 510 for providing access for the pump hose 484 to the fluid inlet fitting 486 of the pump and a forward opening 511 for providing access for the accessory tool hose 436 to the fluid outlet fitting 488 of the pump. The upper and lower portions of the pump housing are connected by snap connections, screws or other means which allow the pump housing to be opened, if necessary, for repair of the pump 480. Alternatively, two portions can be permanently secured together as with an adhesive, sonic welding, or the like.

In operation, the extractor is switched on by operating a pair of switches 512, 514 located on the directing handle assembly 12, as shown in FIG. 1, or other convenient location. The first switch 512 energizes the motor 68 for the brushroll 60. If desired, the extractor may be operated without rotation of the brushroll, such as when the accessory tool is being used. The second switch energizes the fan motor 80. When energized, working air and cleaning solution are extracted from the floor surface to be cleaned and are carried through the nozzle flowpath 138 into the recovery tank 120. Cleaning solution is released under gravity from the spray/drool bar 74 when the handle trigger 422 is actuated. When the recovery tank 120 fills with recovered cleaning solution to a certain level, the float 232 blocks the inlet 214 to the discharge chamber indicated in a change in the sound of the fan 82 or a lack of suction at the nozzle inlet slot 140.

The operator then unlocks the recovery tank from the base housing 10 by releasing the latching member 258 from engagement with the recovery tank carrying handle tab 256 and moves the carrying handle 250 to the carrying position. The operator removes the recovery tank 120, together with the attached nozzle cover 134 and lid 204 and transports it to a sink, or other fluid disposal site. The carrying handle is moved from the carrying position to the emptying position and the lid 204, as well as the attached float cage assembly 224, are detached from the recovery tank. The recovery tank 120 is then inverted to empty it while holding the carrying handle 250 out of the way. The recovered dirt and cleaning solution are emptied from the recovery tank via the discharge opening 200. At the end of a floor cleaning process, or if excess dirt has built up on the filter cup 236 during the cleaning process, the foam cup may be rinsed to remove accumulated dirt. The nozzle flowpath 138, being attached to the recovery tank, is also readily rinsed to remove trapped dirt, as desired. In cases where trapped dirt cannot be removed by rinsing, the nozzle cover 134 may be detached from the recovery tank for a more thorough cleaning.

When it is desired to convert the extractor from the floor cleaning to a remote cleaning mode for cleaning upholstery, stairs, and the like, the brushroll motor 68 is deenergized by tripping the switch 512. The inlet slot cover 184 is removed from the opening 172 and the pump housing 490 is positioned on the base assembly A such that the protrusion 496 of the L-shaped pump housing tube extends into the recovery tank inlet slot 170. The electric cable 506 is electrically connected with the base assembly A to energize the solution supply pump 480. The male quick connect coupling 464 on the pump hose 484 is attached to the female connector 466 on the valve assembly 340, allowing cleaning solution to pass from the cleaning solution supply tank 14, through the valve assembly and pump hose to the pump 480 and thence, under pressure, to the accessory tool hose 436. A trigger 516, at the remote end of the tool hose, is actuated, as required, to allow the cleaning solution, under pressure, to be sprayed through the remote distributor 438 as shown in FIG. 3. The vacuum hose of the accessory tool is coupled by the tubular coupling 502 to the cylindrical portion 500 of the L-shaped tube 494. Specifically, the vacuum hose is connected at its remote end to an accessory nozzle 518. The nozzle may have any desired shape for accessing corners of upholstery, stairs, and the like. Also, a brush (not shown) may be provided adjacent the nozzle, if desired. Dirt and cleaning solution are drawn through the accessory nozzle 518 by the suction fan 82 and thereafter drawn into the recovery tank 120 through the L-shaped tube 494.

Figure 19:
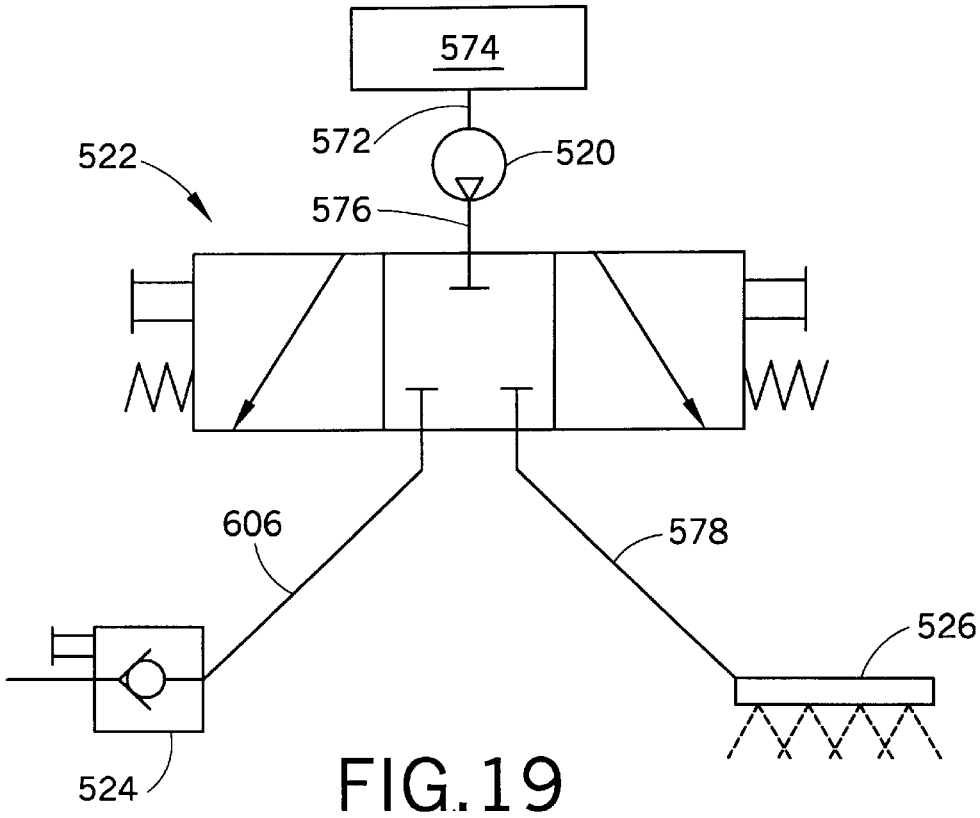
FIG. 19 is a schematic view of a fluid control circuit of a carpet extractor according to a second preferred embodiment of the present invention.
Figure 22:
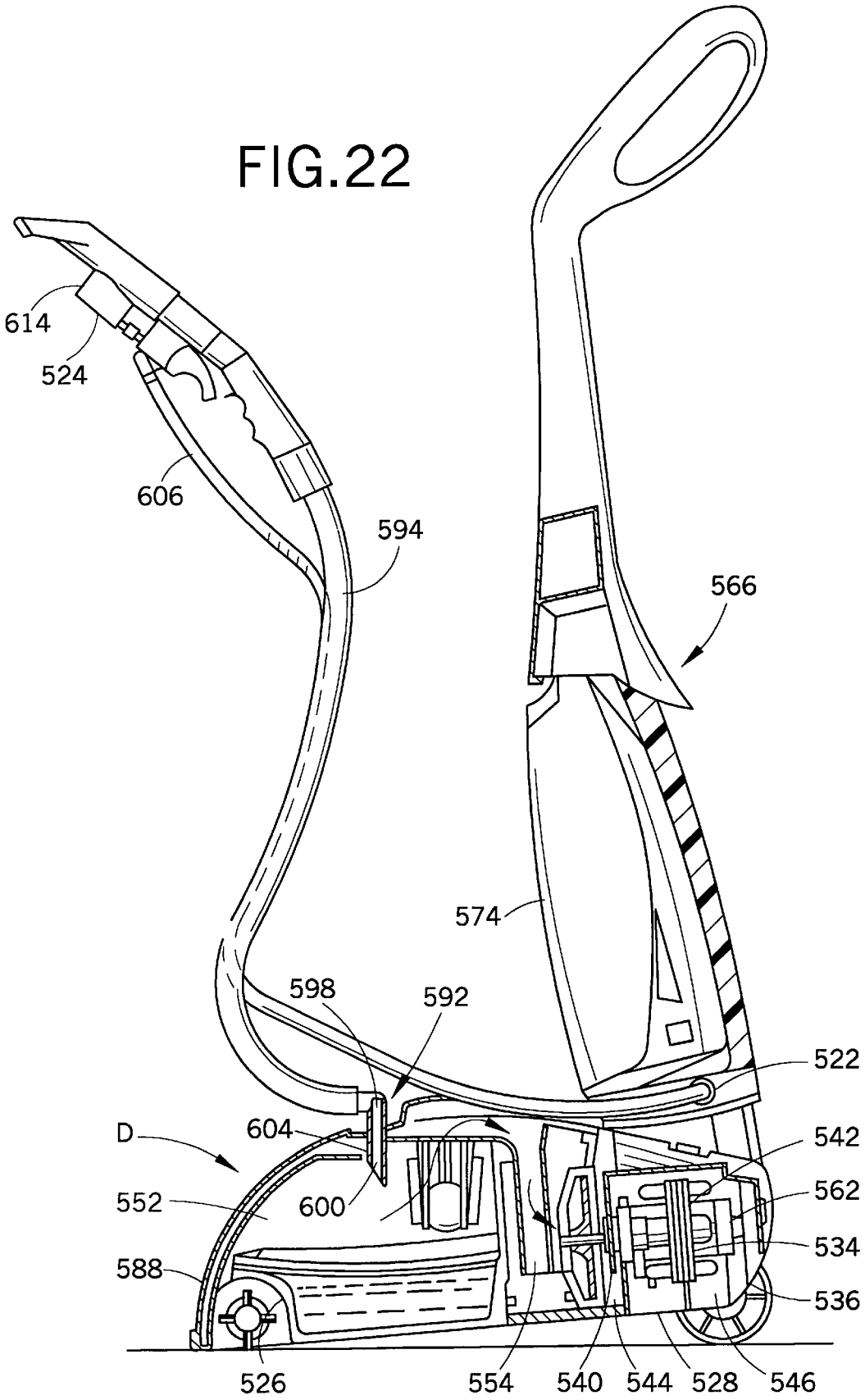
FIG. 22 is a side elevational view, in partial section, of an extractor and attachment tool according to the embodiment of FIG. 19.
Figure 23:
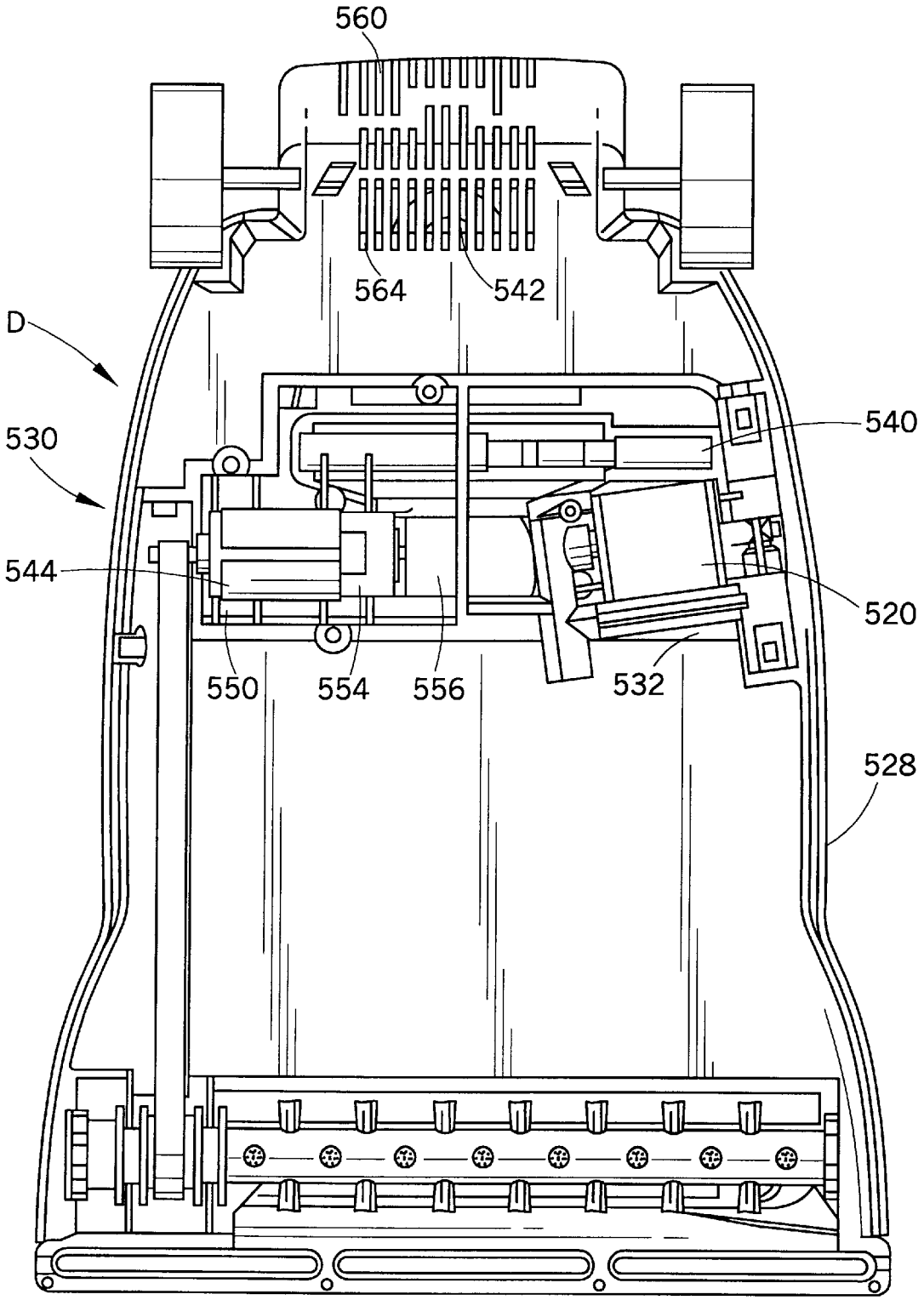
FIG. 23 is an enlarged bottom plan view of the base assembly of FIG. 22; and, FIG. 24 is an enlarged side sectional view of the reservoir and handle assembly of FIG. 13, showing a reservoir latching mechanism.

In the second embodiment, shown in FIGS. 19, 22, and 23, the cleaning solution is pumped, rather than gravity fed, by a solution supply pump 520, such as an electrically driven pump of the type previously described, to a valve assembly 522 of the type described in the first embodiment. This allows both an accessory tool 524 and a spray bar 526 to receive pressurized cleaning solution, as required. In this embodiment, the pump 520 is preferably located in a base assembly D, as shown in FIG. 23. Specifically, a lower surface of a lower housing portion 528 of a base housing 530 defines a downward facing pocket or receptacle 532 for receiving the pump.

A vacuum source, such as a fan and motor assembly 534 is received in a chamber 536 defined in the base housing, as described for the first embodiment. As before, a fan portion 540 and motor portion 542 are axially aligned and received in fan and motor compartments 544, 546 of the chamber. A brushroll motor 544 is located as before in a downward facing indentation or pocket 550 formed in the lower surface of the lower housing portion 528.

The positioning and geometries of the fan 540, fan motor 542, brushroll motor 548 and solution supply pump 520, and their corresponding housing chambers, are designed to minimize the space occupied by these components and provide for a large capacity recovery tank 552. Preferably, the brushroll motor 548 and pump 520 are located in their corresponding pockets on opposite sides of the base housing 530, adjacent to, and generally beneath, an inlet chamber 554 to the fan housing compartment. The inlet chamber has a hemi-disc-shaped indentation in a base wall 556, and the positioning of the brushroll motor and pump on either side of the inlet chamber takes advantage of the open spaces on either side of the disc shape.

Louvers 560, formed in a rear end of the base housing 530 provide an air inlet for drawing in cooling air for cooling the fan motor 542. A cooling fan 562, connected to a rear of the motor 540 is rotated to circulate air around the fan 540 and the cleaning solution pump 520. The same source of air is used for both the pump and the fan motor to minimize the possibility of cleaning fluid being sucked into the base housing. The brushroll motor is cooled by the exhaust air from the fan chamber, i.e., the air being evacuated from the recovery tank 552. The cooling air, which has passed over the pump and fan motor, exits the base housing through a cooling air outlet 564 at the rear of the base housing.

The valve assembly may be mounted on a directing handle 566, as shown in FIG. 22, or may be located in the base assembly, or other suitable location on the extractor. When mounted on the directing handle, a first hose 572 carries cleaning solution from a cleaning solution supply tank 574 to the pump 520 in the base assembly. A second hose 576 carries the cleaning fluid back up to the directing handle-mounted valve assembly 522. A third hose 578 connects the valve assembly and the spray bar 526. The relative positions of the hoses, pump, and valve assembly are shown most clearly in FIG. 19.

In the floor cleaning mode, the spray bar 526 delivers the pressurized cleaning solution to a floor surface to be cleaned. The pump 520 is electrically connected to the motor and fan assembly 534, and runs continuously whenever the motor and fan assembly is energized. The motor and fan assembly draws a vacuum on a floor nozzle flowpath 588 and the associated recovery tank 552, as described for the first embodiment.

To convert the extractor to the remote cleaning mode, a vacuum hose outlet connector 592, which is connected to a vacuum hose 594 of the accessory tool 524, is inserted through an inlet opening 598 into an inlet slot 600 of the recovery tank 552. The outlet connector is shaped for sealing the inlet slot opening 598 and a nozzle outlet 604, closing off the nozzle flowpath 588 from the recovery tank. As shown in FIG. 22, the vacuum hose 594 carries a portion of a cleaning supply hose 606 for the attachment tool within it, facilitating manipulation of the accessory tool. The solution supply hose 606 is coupled by a male coupling to a corresponding female coupling, similar to the male and female couplings 464 and 466 described for the first embodiment, on a second discharge port of the valve assembly to supply pressurized cleaning solution to a distributor 614 at a remote end of the attachment tool. The motor and fan assembly 534 applies a vacuum to the recovery tank, drawing working air and reclaimed cleaning solution from the vacuum hose, through the inlet slot, and into the recovery tank.

In other respects not specifically mentioned above, the extractor of the second embodiment operates as described for the first embodiment.

The invention has been described with reference to the preferred embodiments, obviously, modifications and alterations will occur to others upon a reading and understanding of this specification. It is intended to include all such modifications and alterations insofar as they come within the scope of the appended claims or the equivalents thereof.

Having thus described the preferred embodiments, the invention is now claimed to be:

1. A carpet extractor comprising:

an extractor housing;

a vacuum source mounted on the extractor housing;

a reservoir mounted on the extractor housing for storing and providing a supply of cleaning solution;

a distributor mounted on the extractor housing and communicating with said reservoir for selectively applying the cleaning solution to a floor surface to be cleaned;

a cleaning accessory tool including a cleaning solution supply hose selectively communicating with said reservoir for selectively applying the cleaning solution to a remote surface; and, a valve assembly mounted on the extractor housing, in fluid communication with the reservoir, the distributor and selectively in communication with the cleaning solution supply hose of the cleaning accessory tool for selectively delivering cleaning solution to at least one of the distributor and the accessory tool.

2. The carpet extractor of claim 1, wherein the valve assembly comprises:

a valve housing including a chamber;

an inlet port defined on a wall of the chamber, said inlet port being in fluid communication with the reservoir;

a first discharge port defined on a wall of the chamber, said first discharge port being spaced from said inlet port and being in fluid communication with the distributor; and, a second discharge port defined on a wall of the chamber, said second discharge port being spaced from said inlet port and said first discharge port and being in fluid communication with the cleaning solution supply hose;

a first discharge valve, located in said valve housing, which selectively seals the first discharge port to control a delivery of cleaning solution to the distributor; and, a second discharge valve, located in said valve housing, which selectively seals the second discharge port to control a delivery of cleaning solution to the cleaning solution supply hose.

3. The carpet extractor of claim 2, wherein the first discharge valve includes:

a first valve seat;

a first poppet which selectively engages the first valve seat to seal the first discharge port; and, the second discharge valve includes:

a second valve seat;

a second poppet which selectively engages the second valve seat to seal the second discharge port.

4. The carpet extractor of claim 3, wherein the valve assembly further includes a compression spring which biases the first poppet to a sealing position in which the first poppet engages the first valve seat and which biases the second poppet to a sealing position in which the second poppet engages the second valve seat.

5. The carpet extractor of claim 3, further including an actuator which selectively engages the first poppet for translating the first poppet between the sealing position and an open position, in which a fluid flow path is defined between the inlet port and the first discharge port.

6. The extractor of claim 5, wherein the actuator comprises a rod and the extractor further including a trigger which selectively applies a force to the rod to move the rod into the engaged position.

7. The extractor of claim 6, wherein the rod includes a biasing spring which biases the trigger to the disengaged position.

8. The carpet extractor of claim 3, further including a coupling assembly in fluid communication with the cleaning solution supply hose wherein the coupling assembly selectively couples and uncouples the cleaning solution supply hose and the second discharge port, the coupling assembly being configured to open the second discharge valve when the cleaning solution supply hose and the second discharge port are coupled.

9. The carpet extractor of claim 8, wherein the second poppet includes a valve stem slidingly received in a valve stem passage in fluid communication with the second discharge port, the valve stem defining an interior bore in fluid communication with the second discharge port and an aperture, the valve stem selectively sealing the second discharge port in a first position and providing fluid communication between the chamber and the discharge port in a second position.

10. The carpet extractor of claim 1, further including a solution supply pump for selectively supplying cleaning solution under pressure to the accessory tool, wherein the solution supply pump is fluidly connected between the cleaning solution supply hose and the valve assembly.

11. The carpet extractor of claim 10, further comprising a recovery tank mounted on the extractor housing wherein the recovery tank defines an inlet slot and the solution supply pump is enclosed in a pump housing which is configured for selectively mounting and dismounting over the inlet slot, the pump housing defining an inlet tube, the inlet slot being configured to receive a first end of the inlet tube, a second end of the inlet tube being in fluid communication with an opening in the pump housing which selectively receives a cleaning accessory tool suction hose.

12. The carpet extractor of claim 11, wherein the inlet tube includes a wall which closes a fluid flow path between a suction nozzle inlet slot and the recovery tank when the pump housing is mounted over the recovery tank.

13. The extractor of claim 1, further including a solution supply pump for selectively supplying cleaning solution under pressure to one of the accessory tool and the distributor, wherein the solution supply pump is fluidly connected between the reservoir and the valve assembly.

14. The carpet extractor of claim 13, wherein the extractor includes wheels mounted on the extractor housing for moving the extractor housing over the floor surface to be cleaned.

15. The carpet extractor of claim 1, wherein the reservoir includes a fluid release valve which includes a grommet for sealing the fluid release valve to a wall of the reservoir and selectively sealing around a reservoir valve actuator when the reservoir is fluidly connected with the valve assembly.

16. A carpet extractor, comprising:

an extractor housing;

a vacuum source mounted on the extractor housing;

a cleaning fluid reservoir mounted, on the extractor housing for holding a cleaning fluid;

a distribution bar mounted on the extractor housing for distributing the cleaning fluid to a floor surface to be cleaned;

a first fluid line located on the extractor housing communicating the distribution bar with the reservoir;

a valve assembly mounted on the extractor housing communicating with the first fluid line for controlling the delivery of cleaning fluid to the distribution bar;

a cleaning accessory tool which is selectively connected to the valve assembly for applying cleaning fluid to an above-floor surface;

a second fluid line, connected to the cleaning accessory tool for communicating with the valve assembly, wherein the valve assembly controls the delivery of cleaning fluid to the cleaning accessory tool; and, a pump for pressurizing the cleaning fluid being delivered to the cleaning accessory tool, the pump communicating with at least one of the first fluid line and the second fluid line, said pump being mounted on one of the extractor housing and the cleaning accessory tool.

17. The carpet extractor of claim 16, wherein the valve assembly comprises:

a valve housing including a chamber;

an inlet port defined on a wall of the chamber;

a first discharge port defined on a wall of the chamber and spaced from the inlet port;

a second discharge port defined on a wall of the chamber and spaced from the inlet port and the first discharge port;

a first poppet valve located in the chamber for selectively closing the first discharge port; and, a second poppet valve located in the chamber for selectively closing the second discharge port.

18. The carpet extractor of claim 17, further comprising a biasing member for urging the first and second poppet valves into a closed position.

19. The carpet extractor of claim 18, further including an opening element for urging the first poppet valve from a closed position to an open position.

20. The carpet extractor of claim 19, wherein the opening element includes an actuation rod.

21. The carpet extractor of claim 17, further including a quick connect coupling which is selectively coupled between the second fluid line and the valve assembly, and wherein the second poppet valve is translated between the closed position and an open position when the quick connect coupling is coupled.

22. A floor cleaner comprising:

a base housing;

a vacuum source mounted on the extractor housing;

a valve assembly for selectively delivering a fluid through at least a selected one of first and second discharge ports, the valve assembly including:

a first discharge valve which selectively seals the first discharge port in a first position and opens the first discharge port in a second position to deliver the fluid from the first discharge port, and a second discharge valve which selectively seals the second discharge port in a first position and opens the second discharge port in a second position to deliver the fluid from the second discharge port; and, a first distributor mounted on the base housing for applying the fluid to a floor surface, the first distributor being in fluid communication with the first discharge port; and, an attachment tool, selectively connectable to the valve assembly, the attachment tool including a second distributor for applying the fluid to a remote surface, the second distributor being in fluid communication with the second discharge port when the tool is connected to the valve assembly.

23. The floor cleaner of claim 22, wherein the valve assembly further comprises a compression spring which biases the first discharge valve to the first discharge valve first position and the second discharge valve to the second discharge valve first position.

* * * * *